US011408279B2

(12) United States Patent
Zemla et al.

(10) Patent No.: US 11,408,279 B2
(45) Date of Patent: Aug. 9, 2022

(54) SYSTEM AND METHOD FOR NAVIGATING A WELLBORE AND DETERMINING LOCATION IN A WELLBORE

(71) Applicant: DynaEnergetics GmbH & Co. KG, Troisdorf (DE)

(72) Inventors: Andreas Robert Zemla, Much (DE); Thilo Scharf, Letterkenny (IE); Liam McNelis, Bonn (DE); Christian Eitschberger, Munich (DE); Shmuel Silverman, Novato, CA (US)

(73) Assignee: DynaEnergetics Europe GmbH, Troisdorf (DE)

( * ) Notice: Subject to any disclaimer, the term of this patent is extended or adjusted under 35 U.S.C. 154(b) by 175 days.

(21) Appl. No.: 16/537,720

(22) Filed: Aug. 12, 2019

(65) Prior Publication Data

US 2020/0063553 A1 Feb. 27, 2020

Related U.S. Application Data

(60) Provisional application No. 62/831,215, filed on Apr. 9, 2019, provisional application No. 62/823,737, filed
(Continued)

(51) Int. Cl.
*E21B 47/095* (2012.01)
*E21B 23/10* (2006.01)

(52) U.S. Cl.
CPC ..... *E21B 47/095* (2020.05); *E21B 23/10* (2013.01)

(58) Field of Classification Search
CPC ..... E21B 47/095; E21B 23/10; E21B 47/092
See application file for complete search history.

(56) References Cited

U.S. PATENT DOCUMENTS 2,062,974 A 12/1936 Lane
2,216,359 A 10/1940 Spencer
(Continued)

FOREIGN PATENT DOCUMENTS

AR 021476 A1 7/2002
AR 109754 A1 1/2019
(Continued)

OTHER PUBLICATIONS

International Searching Authority, The International Search Report and Written Opinion of International App. No. PCT/IB2019/000537, dated Sep. 25, 2019, 18 pgs.
(Continued)

*Primary Examiner* — Steven A MacDonald
(74) *Attorney, Agent, or Firm* — Moyles IP, LLC

(57) ABSTRACT

Devices, systems and methods for navigating and determining the location of downhole oil and gas wellbore tools are disclosed. The devices, systems, and methods may include a drone including an ultrasound transceiver that generates and receives an ultrasonic signal that interacts with the environment external to the drone and detects, utilizing a processer associated therewith, changes the environment external to the drone. The speed and location of the drone may be determined using the processor. Alternatively, an electromagnetic field generator that generates a field that interacts with the environment external to the drone. When the drone moves through the wellbore, the environment external to the drone constantly changes. Based on this changing environment, the speed and location of the drone is determined using the present devices, systems and methods.

15 Claims, 16 Drawing Sheets

Related U.S. Application Data on Mar. 26, 2019, provisional application No. 62/720,638, filed on Aug. 21, 2018.

(56) References Cited

U.S. PATENT DOCUMENTS 2,358,466 A 9/1944 Miller
2,418,486 A 4/1947 Smylie
2,550,004 A 4/1951 Doll
2,598,651 A 5/1952 Spencer
2,655,993 A 10/1953 Lloyd
2,713,909 A 7/1955 Baker
2,889,775 A 6/1959 Owen
3,013,491 A 12/1961 Poulter
3,170,400 A 2/1965 Nelson
3,173,992 A 3/1965 Boop
3,213,414 A * 10/1965 Moser ..... G01V 1/188 181/106
3,220,480 A 11/1965 Myers
3,244,232 A 4/1966 Myers
3,246,707 A 4/1966 Bell
3,298,437 A 1/1967 Conrad
3,366,179 A 1/1968 Kinley et al.
3,374,735 A 3/1968 Moore
3,504,723 A 4/1970 Cushman et al.
3,565,188 A 2/1971 Hakala
3,859,921 A 1/1975 Stephenson
4,007,790 A 2/1977 Henning
4,007,796 A 2/1977 Boop
4,058,061 A 11/1977 Mansur, Jr. et al.
4,100,978 A 7/1978 Boop
4,140,188 A 2/1979 Vann
4,172,421 A 10/1979 Regalbuto
4,182,216 A 1/1980 DeCaro
4,220,087 A 9/1980 Posson
4,266,613 A 5/1981 Boop
4,269,120 A 5/1981 Brede et al.
4,290,486 A 9/1981 Regalbuto
4,306,628 A 12/1981 Adams, Jr. et al.
4,312,273 A 1/1982 Camp
4,319,526 A 3/1982 DerMott
4,491,185 A 1/1985 McClure
4,496,008 A 1/1985 Pottier et al.
4,512,418 A 4/1985 Regalbuto et al.
4,523,650 A 6/1985 Sehnert et al.
4,534,423 A 8/1985 Regalbuto
4,574,892 A 3/1986 Grigar et al.
4,598,775 A 7/1986 Vann et al.
4,609,057 A 9/1986 Walker et al.
4,619,333 A 10/1986 George
4,621,396 A 11/1986 Walker et al.
4,640,354 A 2/1987 Boisson
4,640,370 A 2/1987 Wetzel
4,650,009 A 3/1987 McClure et al.
4,657,089 A 4/1987 Stout
4,739,839 A 4/1988 Regalbuto et al.
4,747,201 A 5/1988 Donovan et al.
4,753,170 A 6/1988 Regalbuto et al.
4,756,363 A 7/1988 Lanmon et al.
4,757,479 A * 7/1988 Masson ..... G01V 1/44 367/35
4,762,067 A 8/1988 Barker et al.
4,769,734 A 9/1988 Heinemeyer et al.
4,776,393 A 10/1988 Forehand et al.
4,790,383 A 12/1988 Savage et al.
4,800,815 A 1/1989 Appledorn et al.
4,808,925 A 2/1989 Baird
4,850,438 A 7/1989 Regalbuto
4,860,653 A 8/1989 Abouav
4,889,183 A 12/1989 Sommers et al.
4,986,183 A 1/1991 Jacob et al.
5,007,486 A 4/1991 Ricles
5,027,708 A 7/1991 Gonzalez et al.
5,052,489 A 10/1991 Carisella et al.
5,060,573 A 10/1991 Montgomery et al.
5,070,788 A 12/1991 Carisella et al.
5,088,413 A 2/1992 Huber
5,090,321 A 2/1992 Abouav
5,105,742 A 4/1992 Sumner
5,115,196 A 5/1992 Low et al.
5,159,145 A 10/1992 Carisella et al.
5,159,146 A 10/1992 Carisella et al.
5,165,489 A 11/1992 Langston
5,216,197 A 6/1993 Huber et al.
5,223,665 A 6/1993 Burleson et al.
5,237,136 A 8/1993 Langston
5,322,019 A 6/1994 Hyland
5,346,014 A 9/1994 Ross
5,392,860 A 2/1995 Ross
5,436,791 A 7/1995 Turano et al.
5,603,384 A 2/1997 Bethel et al.
5,648,635 A 7/1997 Lussier et al.
5,703,319 A 12/1997 Fritz et al.
5,775,426 A 7/1998 Snider et al.
5,785,130 A 7/1998 Wesson et al.
5,816,343 A 10/1998 Markel et al.
5,831,204 A 11/1998 Lubben et al.
5,837,925 A 11/1998 Nice
5,859,383 A 1/1999 Davison et al.
5,992,289 A 11/1999 George et al.
6,006,833 A 12/1999 Burleson et al.
6,012,525 A 1/2000 Burleson et al.
6,021,095 A 2/2000 Tubel et al.
6,070,662 A 6/2000 Ciglenec et al.
6,112,666 A 9/2000 Murray et al.
6,148,263 A 11/2000 Brooks et al.
6,173,606 B1 1/2001 Mosley
6,173,651 B1 1/2001 Pathe et al.
6,182,765 B1 2/2001 Kilgore
6,216,596 B1 4/2001 Wesson
6,222,749 B1 4/2001 Peron
6,272,782 B1 8/2001 Dittrich et al.
6,274,948 B1 8/2001 Blank et al.
6,298,915 B1 10/2001 George
6,305,287 B1 10/2001 Capers et al.
6,333,699 B1 12/2001 Zierolf
6,354,374 B1 3/2002 Edwards et al.
6,412,388 B1 7/2002 Frazier
6,412,415 B1 7/2002 Kothari et al.
6,418,853 B1 7/2002 Duguet et al.
6,439,121 B1 8/2002 Gillingham
6,454,011 B1 9/2002 Schempf et al.
6,457,526 B1 10/2002 Dailey
6,464,011 B2 10/2002 Tubel
6,474,931 B1 11/2002 Austin et al.
6,487,973 B1 12/2002 Gilbert, Jr. et al.
6,488,093 B2 12/2002 Moss
6,497,285 B2 12/2002 Walker
6,584,406 B1 6/2003 Harmon et al.
6,651,747 B2 11/2003 Chen et al.
6,659,180 B2 12/2003 Moss
6,719,061 B2 4/2004 Muller et al.
6,739,265 B1 5/2004 Badger et al.
6,742,602 B2 6/2004 Trotechaud
6,752,083 B1 6/2004 Lerche et al.
6,779,605 B2 8/2004 Jackson
6,785,116 B1 8/2004 Hummel et al.
6,808,021 B2 10/2004 Zimmerman et al.
6,820,693 B2 11/2004 Hales et al.
6,843,317 B2 1/2005 Mackenzie
6,843,318 B2 1/2005 Yarbro
6,938,689 B2 9/2005 Farrant et al.
6,966,262 B2 11/2005 Jennings, III
6,988,449 B2 1/2006 Teowee et al.
7,000,699 B2 2/2006 Yang et al.
7,018,164 B2 3/2006 Anthis et al.
7,036,598 B2 5/2006 Skjærseth et al.
7,044,230 B2 5/2006 Starr et al.
7,066,261 B2 6/2006 Vicente et al.
7,073,580 B2 7/2006 Wilson et al.
7,082,877 B2 8/2006 Jennings, III
7,093,664 B2 8/2006 Todd et al.
7,107,908 B2 9/2006 Forman et al.
7,140,453 B2 11/2006 Ayling
7,168,494 B2 1/2007 Starr et al.

(56) References Cited

U.S. PATENT DOCUMENTS 7,193,527 B2 3/2007 Hall
7,204,308 B2 4/2007 Dudley et al.
7,217,917 B1 5/2007 Tumlin et al.
7,234,521 B2 6/2007 Shammai et al.
7,234,525 B2 6/2007 Alves et al.
7,240,742 B2 7/2007 Sewell et al.
7,273,102 B2 9/2007 Sheffield
7,278,491 B2 10/2007 Scott
7,301,750 B2 11/2007 DeVries et al.
7,322,416 B2 1/2008 Burris, II et al.
7,331,394 B2 2/2008 Edwards et al.
7,347,145 B2 3/2008 Teowee et al.
7,347,278 B2 3/2008 Lerche et al.
7,347,279 B2 3/2008 Li et al.
7,353,879 B2 4/2008 Todd et al.
7,363,967 B2 4/2008 Burris et al.
7,364,451 B2 4/2008 Ring et al.
7,441,601 B2 10/2008 George et al.
7,464,647 B2 12/2008 Teowee et al.
7,568,429 B2 8/2009 Hummel et al.
7,574,960 B1 8/2009 Dockery et al.
7,588,080 B2 9/2009 McCoy
7,617,775 B2 11/2009 Teowee
7,631,704 B2 12/2009 Hagemeyer et al.
7,681,500 B2 3/2010 Teowee
7,735,578 B2 6/2010 Loehr et al.
7,752,971 B2 7/2010 Loehr
7,762,172 B2 7/2010 Li et al.
7,762,351 B2 7/2010 Vidal
7,775,273 B2 8/2010 Merlau et al.
7,775,279 B2 8/2010 Marya et al.
7,778,006 B2 8/2010 Stewart et al.
7,802,619 B2 9/2010 Hurst et al.
7,810,430 B2 10/2010 Chan et al.
7,870,825 B2 1/2011 Teowee
7,886,842 B2 2/2011 Howard et al.
7,901,247 B2 3/2011 Ring
7,908,970 B1 3/2011 Jakaboski et al.
7,929,270 B2 4/2011 Hummel et al.
8,006,765 B2 8/2011 Richards et al.
8,056,632 B2 11/2011 Goodman
8,066,083 B2 11/2011 Hales et al.
8,069,789 B2 12/2011 Hummel et al.
8,074,713 B2 12/2011 Ramos et al.
8,074,737 B2 12/2011 Hill et al.
8,127,846 B2 3/2012 Hill et al.
8,136,585 B2 3/2012 Cherewyk
8,141,434 B2 3/2012 Kippersund et al.
8,141,639 B2 3/2012 Gartz et al.
8,151,882 B2 4/2012 Grigar et al.
8,157,022 B2 4/2012 Bertoja et al.
8,181,718 B2 5/2012 Burleson et al.
8,182,212 B2 5/2012 Parcell
8,186,259 B2 5/2012 Burleson et al.
8,256,337 B2 9/2012 Hill
8,317,448 B2 11/2012 Hankins et al.
8,327,746 B2 12/2012 Behrmann et al.
8,395,878 B2 3/2013 Stewart et al.
8,413,727 B2 4/2013 Holmes
8,451,137 B2 5/2013 Bonavides et al.
8,505,632 B2 8/2013 Guerrero et al.
8,582,275 B2 11/2013 Yan et al.
8,596,378 B2 12/2013 Mason et al.
8,646,520 B2 2/2014 Chen
8,661,978 B2 3/2014 Backhus et al.
8,695,506 B2 4/2014 Lanclos
8,810,247 B2 8/2014 Kuckes
8,863,665 B2 10/2014 DeVries et al.
8,875,787 B2 11/2014 Tassaroli
8,881,816 B2 11/2014 Glenn et al.
8,899,322 B2 12/2014 Cresswell et al.
8,904,935 B1 12/2014 Brown et al.
8,950,480 B1 2/2015 Strickland
8,981,957 B2 3/2015 Gano et al.
8,985,023 B2 3/2015 Mason
9,062,539 B2 6/2015 Schmidt et al.
9,080,433 B2 7/2015 Lanclos et al.
9,133,695 B2 9/2015 Xu
9,145,748 B1 9/2015 Meier et al.
9,157,718 B2 10/2015 Ross
9,181,790 B2 11/2015 Mace et al.
9,194,219 B1 11/2015 Hardesty et al.
9,206,675 B2 12/2015 Hales et al.
9,267,346 B2 2/2016 Robertson et al.
9,284,819 B2 3/2016 Tolman et al.
9,284,824 B2 3/2016 Fadul et al.
9,317,038 B2 4/2016 Ozick et al.
9,328,577 B2 5/2016 Hallundbaek et al.
9,359,863 B2 6/2016 Streich et al.
9,359,884 B2 6/2016 Hallundbaek et al.
9,382,783 B2 7/2016 Langford et al.
9,383,237 B2 7/2016 Wiklund et al.
9,441,470 B2 9/2016 Guerrero et al.
9,464,508 B2 10/2016 Lerche et al.
9,476,289 B2 10/2016 Wells
9,482,069 B2 11/2016 Powers
9,494,021 B2 11/2016 Parks et al.
9,523,255 B2 12/2016 Andrzejak
9,556,725 B2 1/2017 Fripp et al.
9,574,416 B2 2/2017 Wright et al.
9,581,422 B2 2/2017 Preiss et al.
9,598,942 B2 3/2017 Wells et al.
9,605,937 B2 3/2017 Eitschberger et al.
9,617,814 B2 4/2017 Seals et al.
9,617,829 B2 4/2017 Dale et al.
9,677,363 B2 6/2017 Schacherer et al.
9,689,223 B2 6/2017 Schacherer et al.
9,702,680 B2 7/2017 Parks et al.
9,726,005 B2 8/2017 Hallundbaek et al.
9,784,549 B2 10/2017 Eitschberger
9,790,763 B2 10/2017 Fripp et al.
9,797,238 B2 10/2017 Frosell et al.
9,903,192 B2 2/2018 Entchev et al.
9,926,755 B2 3/2018 Van Petegem et al.
9,963,398 B2 5/2018 Greeley et al.
9,963,955 B2 5/2018 Tolman et al.
10,000,994 B1 6/2018 Sites
10,001,007 B2 6/2018 Pelletier et al.
10,047,592 B2 8/2018 Burgos et al.
10,053,968 B2 8/2018 Tolman et al.
10,066,921 B2 9/2018 Eitschberger
10,077,641 B2 9/2018 Rogman et al.
10,100,612 B2 10/2018 Lisowski et al.
10,138,713 B2 11/2018 Tolman et al.
10,151,180 B2 12/2018 Robey et al.
10,167,534 B2 1/2019 Fripp et al.
10,167,691 B2 1/2019 Zhang et al.
10,188,990 B2 1/2019 Burmeister et al.
10,190,398 B2 1/2019 Goodman et al.
10,246,952 B2 4/2019 Trydal et al.
10,267,611 B2 4/2019 Lownds et al.
10,273,788 B2 4/2019 Bradley et al.
10,287,873 B2 5/2019 Filas et al.
10,301,910 B2 5/2019 Whitsitt et al.
10,323,484 B2 6/2019 Liess
10,352,144 B2 7/2019 Entchev et al.
10,358,880 B2 7/2019 Metcalf et al.
10,458,213 B1 10/2019 Eitschberger et al.
10,598,002 B2 3/2020 Sites
10,605,578 B2 3/2020 Zemla et al.
10,689,955 B1 6/2020 Mauldin et al.
10,794,159 B2 10/2020 Eitschberger et al.
10,844,696 B2 11/2020 Eitschberger et al.
10,927,650 B2 2/2021 Schultz et al.
11,009,330 B2 5/2021 Saltarelli et al.
2002/0020320 A1 2/2002 Lebaudy et al.
2002/0036101 A1 3/2002 Huhdanmaki et al.
2002/0040783 A1 4/2002 Zimmerman et al.
2002/0062991 A1 5/2002 Farrant et al.
2002/0129941 A1 9/2002 Alves et al.
2002/0134552 A1 9/2002 Moss
2002/0145423 A1* 10/2002 Yoo ..... G01N 27/82
324/221
2003/0000411 A1 1/2003 Cernocky et al.

(56) References Cited

U.S. PATENT DOCUMENTS

2003/0001753 A1 1/2003 Cernocky et al.
2004/0094305 A1 5/2004 Skjærseth et al.
2004/0216632 A1 11/2004 Finsterwald
2004/0239521 A1 12/2004 Zierolf
2005/0011390 A1 1/2005 Jennings
2005/0011645 A1 1/2005 Aronstam et al.
2005/0103526 A1 5/2005 Ayling
2005/0167101 A1 8/2005 Sugiyama
2005/0178282 A1 8/2005 Brooks et al.
2005/0183610 A1 8/2005 Barton et al.
2005/0186823 A1 8/2005 Ring et al.
2005/0194146 A1 9/2005 Barker et al.
2005/0217844 A1 10/2005 Edwards et al.
2005/0229805 A1 10/2005 Myers, Jr. et al.
2005/0269083 A1 12/2005 Burris, II et al.
2006/0054326 A1 3/2006 Alves et al.
2007/0084336 A1 4/2007 Neves
2007/0125540 A1 6/2007 Gerez et al.
2007/0158071 A1 7/2007 Mooney, Jr. et al.
2007/0267195 A1 11/2007 Grigar et al.
2008/0047456 A1 2/2008 Li et al.
2008/0110612 A1 5/2008 Prinz et al.
2008/0121095 A1 5/2008 Han et al.
2008/0134922 A1 6/2008 Grattan et al.
2008/0149338 A1 6/2008 Goodman et al.
2008/0173204 A1 7/2008 Anderson et al.
2008/0223587 A1 9/2008 Cherewyk
2008/0264639 A1 10/2008 Parrott et al.
2008/0307875 A1* 12/2008 Hassan ..... E21B 47/095 73/152.16
2009/0050322 A1 2/2009 Hill et al.
2009/0159285 A1 6/2009 Goodman
2009/0183916 A1 7/2009 Pratt et al.
2009/0211760 A1 8/2009 Richards et al.
2009/0255728 A1 10/2009 Spencer et al.
2009/0272529 A1 11/2009 Crawford
2009/0301723 A1 12/2009 Gray
2010/0000789 A1 1/2010 Barton et al.
2010/0089643 A1 4/2010 Vidal
2010/0096131 A1 4/2010 Hill et al.
2010/0163224 A1 7/2010 Strickland
2010/0206064 A1 8/2010 Estes
2010/0230104 A1 9/2010 Nölke et al.
2010/0288496 A1 11/2010 Cherewyk
2011/0005777 A1 1/2011 Meff
2011/0024116 A1 2/2011 McCann et al.
2012/0085538 A1* 4/2012 Guerrero ..... E21B 43/14 166/284
2012/0152542 A1 6/2012 Le
2012/0160491 A1 6/2012 Goodman et al.
2012/0180678 A1 7/2012 Kneisl
2012/0199031 A1 8/2012 Lanclos
2012/0199352 A1 8/2012 Lanclos et al.
2012/0226443 A1* 9/2012 Cresswell ..... E21B 47/04 702/11
2012/0241169 A1 9/2012 Hales et al.
2012/0242135 A1 9/2012 Thomson et al.
2012/0247769 A1 10/2012 Schacherer et al.
2012/0247771 A1 10/2012 Black et al.
2012/0281829 A1 11/2012 Rudakevych et al.
2012/0298361 A1 11/2012 Sampson
2013/0008639 A1 1/2013 Tassaroli et al.
2013/0048376 A1 2/2013 Rodgers et al.
2013/0062055 A1* 3/2013 Tolman ..... E21B 43/119 166/250.01
2013/0118342 A1 5/2013 Tassaroli
2013/0118805 A1 5/2013 Moody-Stuart et al.
2013/0153205 A1 6/2013 Borgfeld et al.
2013/0199843 A1 8/2013 Ross
2013/0228326 A1 9/2013 Griffith et al.
2013/0248174 A1* 9/2013 Dale ..... E21B 23/00 166/255.1
2014/0053750 A1 2/2014 Lownds et al.
2014/0076542 A1* 3/2014 Whitsitt ..... E21B 34/14 166/250.1
2014/0083774 A1 3/2014 Hoult et al.
2014/0131035 A1 5/2014 Entchev et al.
2014/0138090 A1 5/2014 Hill et al.
2014/0218207 A1 8/2014 Gano et al.
2014/0360720 A1 12/2014 Corbeil
2015/0041124 A1 2/2015 Rodriguez
2015/0075783 A1 3/2015 Angman et al.
2015/0114626 A1 4/2015 Hatten et al.
2015/0167410 A1 6/2015 Garber et al.
2015/0176386 A1 6/2015 Castillo et al.
2015/0209954 A1 7/2015 Hokanson
2015/0226044 A1 8/2015 Ursi et al.
2015/0275615 A1 10/2015 Rytlewski et al.
2015/0330192 A1 11/2015 Rogman et al.
2015/0337648 A1* 11/2015 Zippel ..... E21B 33/14 166/255.1
2015/0354310 A1 12/2015 Zaiser
2015/0376991 A1 12/2015 Mcnelis et al.
2016/0003025 A1* 1/2016 Beekman ..... E21B 47/11 250/269.5
2016/0032711 A1* 2/2016 Sheiretov ..... E21B 45/00 73/152.54
2016/0040520 A1 2/2016 Tolman et al.
2016/0050724 A1 2/2016 Moon et al.
2016/0061572 A1 3/2016 Eitschberger et al.
2016/0069163 A1 3/2016 Tolman et al.
2016/0084048 A1 3/2016 Harrigan et al.
2016/0084075 A1* 3/2016 Ingraham ..... E21B 23/01 166/255.1
2016/0108722 A1* 4/2016 Whitsitt ..... E21B 34/14 166/254.1
2016/0115741 A1 4/2016 Davis
2016/0168961 A1 6/2016 Parks et al.
2016/0215592 A1 7/2016 Helms et al.
2016/0258240 A1 9/2016 Fripp et al.
2016/0273902 A1 9/2016 Eitschberger
2016/0290098 A1 10/2016 Marya
2016/0320769 A1* 11/2016 Deffenbaugh ..... E21B 47/26
2016/0356132 A1 12/2016 Burmeister et al.
2016/0369620 A1* 12/2016 Pelletier ..... E21B 23/14
2017/0030693 A1 2/2017 Preiss et al.
2017/0044875 A1 2/2017 Hebebrand et al.
2017/0052011 A1 2/2017 Parks et al.
2017/0058649 A1 3/2017 Geerts et al.
2017/0067303 A1 3/2017 Thiemann et al.
2017/0067320 A1 3/2017 Zouhair et al.
2017/0145798 A1 5/2017 Robey et al.
2017/0159379 A1 6/2017 Metcalf et al.
2017/0167233 A1 6/2017 Sampson et al.
2017/0175488 A1 6/2017 Lisowski et al.
2017/0175500 A1 6/2017 Robey et al.
2017/0199015 A1 7/2017 Collins et al.
2017/0204687 A1 7/2017 Yorga et al.
2017/0211363 A1 7/2017 Bradley et al.
2017/0211381 A1* 7/2017 Chemali ..... E21B 49/00
2017/0241244 A1 8/2017 Barker et al.
2017/0268320 A1 9/2017 Angman et al.
2017/0268326 A1 9/2017 Tao et al.
2017/0268860 A1 9/2017 Eitschberger
2017/0275976 A1 9/2017 Collins et al.
2017/0306710 A1 10/2017 Trydal et al.
2017/0314372 A1 11/2017 Tolman et al.
2017/0314385 A1* 11/2017 Hori ..... E21B 17/20
2017/0357021 A1 12/2017 Valero et al.
2018/0002999 A1 1/2018 Johnson
2018/0003038 A1 1/2018 Cherewyk
2018/0003045 A1 1/2018 Dotson et al.
2018/0030334 A1 2/2018 Collier et al.
2018/0045498 A1 2/2018 Teowee et al.
2018/0087369 A1 3/2018 Sherman et al.
2018/0100387 A1* 4/2018 Kouchmeshky ..... G01V 1/52
2018/0135398 A1 5/2018 Entchev et al.
2018/0148995 A1 5/2018 Burky et al.
2018/0156029 A1 6/2018 Harrison et al.
2018/0171757 A1 6/2018 Xu
2018/0209250 A1 7/2018 Daly et al.
2018/0209251 A1 7/2018 Robey et al.

(56) References Cited

U.S. PATENT DOCUMENTS

| | | | | |
|---|---|---|---|---|
| 2018/0231361 | A1 | 8/2018 | Wicks et al. | |
| 2018/0274342 | A1 | 9/2018 | Sites | |
| 2018/0283836 | A1 | 10/2018 | Thomas | |
| 2018/0299239 | A1 | 10/2018 | Eitschberger et al. | |
| 2018/0306010 | A1 | 10/2018 | Von Kaenel et al. | |
| 2018/0313182 | A1 | 11/2018 | Cherewyk et al. | |
| 2018/0318770 | A1 | 11/2018 | Eitschberger et al. | |
| 2018/0340412 | A1 | 11/2018 | Singh et al. | |
| 2018/0355674 | A1 | 12/2018 | Cooper et al. | |
| 2018/0363450 | A1* | 12/2018 | Legendre | E21B 47/095 |
| 2019/0031307 | A1 | 1/2019 | Siersdorfer | |
| 2019/0040722 | A1 | 2/2019 | Yang et al. | |
| 2019/0048693 | A1 | 2/2019 | Henke et al. | |
| 2019/0049225 | A1 | 2/2019 | Eitschberger | |
| 2019/0071963 | A1* | 3/2019 | Sites | E21B 47/092 |
| 2019/0085685 | A1 | 3/2019 | McBride | |
| 2019/0136673 | A1 | 5/2019 | Sullivan et al. | |
| 2019/0186211 | A1 | 6/2019 | Gonzalez | |
| 2019/0195054 | A1 | 6/2019 | Bradley et al. | |
| 2019/0211655 | A1 | 7/2019 | Bradley et al. | |
| 2019/0218880 | A1 | 7/2019 | Cannon et al. | |
| 2019/0284889 | A1 | 9/2019 | LaGrange et al. | |
| 2019/0292887 | A1 | 9/2019 | Austin, II et al. | |
| 2019/0316449 | A1* | 10/2019 | Schultz | E21B 47/06 |
| 2019/0322342 | A1* | 10/2019 | Dabbous | E21B 47/12 |
| 2019/0323810 | A1 | 10/2019 | Saltarelli et al. | |
| 2019/0338606 | A1 | 11/2019 | Metcalf et al. | |
| 2019/0353013 | A1 | 11/2019 | Sokolove et al. | |
| 2019/0366272 | A1 | 12/2019 | Eitschberger et al. | |
| 2019/0368301 | A1 | 12/2019 | Eitschberger et al. | |
| 2019/0368321 | A1 | 12/2019 | Eitschberger et al. | |
| 2019/0368331 | A1 | 12/2019 | Vick, Jr. et al. | |
| 2020/0018139 | A1* | 1/2020 | Eitschberger | E21B 43/117 |
| 2020/0063553 | A1 | 2/2020 | Zemla et al. | |
| 2020/0157909 | A1 | 5/2020 | Fernandes et al. | |
| 2020/0332618 | A1 | 10/2020 | Eitschberger et al. | |
| 2020/0370421 | A1* | 11/2020 | Fripp | E21B 47/095 |
| 2020/0392821 | A1 | 12/2020 | Eitschberger et al. | |
| 2020/0400417 | A1 | 12/2020 | Eitschberger et al. | |
| 2021/0040809 | A1 | 2/2021 | Eitschberger | |
| 2021/0123330 | A1 | 4/2021 | Eitschberger et al. | |
| 2021/0198983 | A1 | 7/2021 | Eitschberger et al. | |
| 2021/0199002 | A1 | 7/2021 | Zemla et al. | |
| 2021/0215039 | A1 | 7/2021 | Scharf et al. | |
| 2021/0238966 | A1 | 8/2021 | Preiss et al. | |

FOREIGN PATENT DOCUMENTS

| | | | |
|---|---|---|---|
| CA | 2385517 | A1 | 4/2001 |
| CA | 2833722 | A1 | 5/2014 |
| CA | 2821506 | A1 | 1/2015 |
| CA | 2941648 | A1 | 9/2015 |
| CN | 85107897 | A | 9/1986 |
| CN | 1217784 | A | 5/1999 |
| CN | 1545609 | A | 11/2004 |
| CN | 2661919 | | 12/2004 |
| CN | 201184775 | | 1/2009 |
| CN | 101397890 | A | 4/2009 |
| CN | 201546707 | U | 8/2010 |
| CN | 201620848 | U | 11/2010 |
| CN | 104296608 | A | 1/2015 |
| CN | 104345214 | A | 2/2015 |
| CN | 204430910 | U | 7/2015 |
| DE | 3412798 | A1 | 10/1985 |
| DE | 4302009 | A1 | 7/1994 |
| DE | 4330195 | C1 | 11/1994 |
| DE | 19740019 | A1 | 3/1999 |
| DE | 10017703 | A1 | 5/2001 |
| DE | 10341437 | A1 | 4/2005 |
| DE | 10344523 | A1 | 4/2005 |
| DE | 102004044683 | A1 | 3/2006 |
| DE | 102005031673 | A1 | 3/2006 |
| DE | 602004006439 | T2 | 1/2008 |
| EP | 0088516 | A1 | 9/1983 |
| EP | 0207749 | A2 | 1/1987 |
| EP | 1644692 | B1 | 12/2009 |
| EP | 1688584 | B1 | 8/2011 |
| EP | 2952675 | A2 | 9/2015 |
| EP | 2310616 | B1 | 10/2017 |
| EP | 3478928 | B1 | 6/2021 |
| ES | 2000183 | | 1/1988 |
| GB | 839486 | A | 6/1960 |
| GB | 2395970 | A | 6/2004 |
| GB | 2533822 | A | 7/2016 |
| GB | 2548101 | A | 9/2017 |
| GB | 2534484 | B | 4/2020 |
| JP | 2001515815 | A | 9/2001 |
| RU | 93521 | U1 | 4/2010 |
| RU | 2633904 | C1 | 10/2017 |
| WO | 1994021882 | A1 | 9/1994 |
| WO | 9721067 | A1 | 6/1997 |
| WO | 9745696 | A1 | 12/1997 |
| WO | 1998046965 | A1 | 10/1998 |
| WO | 2009846965 | A1 | 10/1998 |
| WO | 9912773 | A1 | 3/1999 |
| WO | 0123827 | A1 | 4/2001 |
| WO | 0133029 | A3 | 5/2001 |
| WO | 0159401 | A1 | 8/2001 |
| WO | 2001059401 | A1 | 8/2001 |
| WO | 0133029 | A2 | 12/2001 |
| WO | 2009091422 | A2 | 7/2009 |
| WO | 2011027991 | A2 | 3/2011 |
| WO | 2011051435 | A2 | 5/2011 |
| WO | 2011146866 | A2 | 11/2011 |
| WO | 2011150251 | A1 | 12/2011 |
| WO | 2012006357 | A2 | 1/2012 |
| WO | 2012106640 | A3 | 11/2012 |
| WO | 2012149584 | A1 | 11/2012 |
| WO | 2012161854 | A2 | 11/2012 |
| WO | 2014007843 | A1 | 1/2014 |
| WO | 2014089194 | A1 | 6/2014 |
| WO | 2014193397 | A1 | 12/2014 |
| WO | 2015006869 | A1 | 1/2015 |
| WO | 2015081092 | A2 | 6/2015 |
| WO | 2015081092 | A3 | 8/2015 |
| WO | 2015134719 | A1 | 9/2015 |
| WO | 2015173592 | A1 | 11/2015 |
| WO | 2017147329 | A1 | 8/2017 |
| WO | 2018009223 | A1 | 1/2018 |
| WO | 2018067598 | A1 | 4/2018 |
| WO | 2018094220 | A1 | 5/2018 |
| WO | 2018141423 | A1 | 8/2018 |
| WO | 2018177733 | A1 | 10/2018 |
| WO | 2018182565 | A1 | 10/2018 |
| WO | 2019033183 | A1 | 2/2019 |
| WO | 2019147294 | A1 | 8/2019 |
| WO | 2019148009 | A2 | 8/2019 |
| WO | 2019180462 | A1 | 9/2019 |
| WO | 2019229520 | A1 | 12/2019 |
| WO | 2019229521 | A1 | 12/2019 |
| WO | 2020002383 | A1 | 1/2020 |
| WO | 2020002983 | A1 | 1/2020 |
| WO | 2020035616 | A1 | 2/2020 |
| WO | 2020200935 | A1 | 10/2020 |
| WO | 2020254099 | A1 | 12/2020 |
| WO | 2021013731 | A1 | 1/2021 |
| WO | 2021116336 | A1 | 6/2021 |
| WO | 2021116338 | A1 | 6/2021 |
| ZA | 200202372 | B | 3/2003 |

OTHER PUBLICATIONS

Amit Govil, Selective Perforation: A Game Changer in Perforating Technology—Case Study, presented at the 2012 European and West African Perforating Symposium, Schlumberger, Nov. 7-9, 2012, 14 pgs.

Austin Powder Company; A—140 F & Block, Detonator & Block Assembly; Jan. 5, 2017; 2 pgs.; https://www.austinpowder.com/wp-content/uploads/2019/01/OilStar_A140Fbk-2.pdf.

Baker Hughes, Long Gun Deployment Systems IPS-12-28; 2012 International Perforating Symposium; Apr. 26-27, 2011; 11 pages.

Baker Hughes; SurePerf Rapid Select-Fire System Perforate production zones in a single run; 2012; 2 pages.

(56) References Cited

OTHER PUBLICATIONS

Dynaenergetics, DYNAselect Electronic Detonator 0015 SFDE RDX 1.4B, Product Information, Dec. 16, 2011, 1 pg.
Dynaenergetics, DYNAselect Electronic Detonator 0015 SFDE RDX 1.4S, Product Information, Dec. 16, 2011, 1 pg.
Dynaenergetics, DYNAselect System, information downloaded from website, Jul. 3, 2013, 2 pages, http://www.dynaenergetics.com/.
Dynaenergetics, Electronic Top Fire Detonator, Product Information Sheet, Jul. 30, 2013, 1 pg.
Dynaenergetics, Gun Assembly, Product Summary Sheet, May 7, 2004, 1 page.
Dynaenergetics, Selective Perforating Switch, information downloaded from website, Jul. 3, 2013, 2 pages, http://www.dynaenergetics.com/.
Dynaenergetics, Selective Perforating Switch, Product Information Sheet, May 27, 2011, 1 pg.
Eric H. Findlay, Jury Trial Demand in Civil Action No. 6:20-cv-00069-ADA, dated Apr. 22, 2020, 32 pages.
Gilliat et al.; New Select-Fire System: Improved Reliability and Safety in Select Fire Operations; 2012; 16 pgs.
Horizontal Wireline Services, Presentation of a completion method of shale demonstrated through an example of Marcellus Shale, Pennsylvania, USA, Presented at 2012 International Perforating Symposium (Apr. 26-28, 2012), 17 pages.
Hunting Titan Inc.; Petition for Post Grant Review of U.S. Pat. No. 10,429,161; dated Jun. 30, 2020; 109 pages.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Jet Research Center Inc., JRC Catalog, 2008, 36 pgs., https://www.jetresearch.com/content/dam/jrc/Documents/Books_Catalogs/06_Dets.pdf.
Jet Research Center Inc., Red RF Safe Detonators Brochure, 2008, 2 pages, www.jetresearch.com.
Owen Oil Tools & Pacific Scientific; RF-Safe Green Det, Side Block for Side Initiation, Jul. 26, 2017, 2 pgs.
Owen Oil Tools, Recommended Practice for Oilfield Explosive Safety, Presented at 2011 MENAPS Middle East and North Africa Perforating Symposium, Nov. 28-30, 2011, 6 pages.
Schlumberger & Said Abubakr, Combining and Customizing Technologies for Perforating Horizontal Wells in Algeria, Presented at 2011 MENAPS, Nov. 28-30, 2011, 20 pages.
Smylie, Tom, New Safe and Secure Detonators for the Industry's consideration, presented at Explosives Safety & Security Conference, Marathon Oil Co, Houston; Feb. 23-24, 2005, 20 pages.
U.S. Patent Trial and Appeal Board, Institution of Inter Partes Review of U.S. Pat. No. 9,581,422, Case IPR2018-00600, Aug. 21, 2018, 9 pages.
United States District Court for the Southern District of Texas Houston Division, Case 4:19-cv-01611 for U.S. Pat. No. 9,581,422B2, Plaintiff's Complaint and Exhibits, dated May 2, 2019, 26 pgs.
United States District Court for the Southern District of Texas Houston Division, Case 4:19-cv-01611 for U.S. Pat. No. 9,581,422B2, Defendant's Answers, Counterclaims and Exhibits, dated May 28, 2019, 135 pgs.
United States District Court for the Southern District of Texas Houston Division, Case 4:19-cv-01611 for U.S. Pat. No. 9,581,422B2, Plaintiffs' Motion to Dismiss and Exhibits, dated Jun. 17, 2019, 63 pgs.
United States Patent and Trademark Office, Case IPR2018-00600 for U.S. Pat. No. 9,581,422 B2, Reply In Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of U.S. Pat. No. 9,581,422, dated Mar. 7, 2019, 44 pgs.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trial Appeal Board; Final Written Decision on IPR2018-00600; dated Aug. 20, 2019; 31 pages.
USPTO, Office Action of U.S. Appl. No. 16/788,107, dated Apr. 6, 2020, 15 pgs.
Wade et al., Field Tests Indicate New Perforating Devices Improve Efficiency in Casing Completion Operations, SPE 381, pp. 1069-1073, Oct. 1962, 5 pages.
United States Patent and Trademark Office, Final Office Action of U.S. Appl. No. 16/423,230, which cited reference US Publication No. 20140131035A1, dated Nov. 4, 2019, 14 pgs.
International Searching Authority, International Search Report and Written Opinion of International App No. PCT/EP2019/072032, which is in the same family as U.S. Appl. No. 16/537,720, dated Nov. 15, 2019, 13 pgs.
United States Patent and Trademark Office, Non-final Office Action of U.S. Appl. No. 16/451,440, which cited reference US Publication No. 20190316449A1, dated Oct. 24, 2019, 22 pgs.
Dalia Abdallah et al., Casing Corrosion Measurement to Extend Asset Life, Dec. 31, 2013, 14 pgs., https://www.slb.com/-/media/files/oilfield-review/2-casing-corr-2-english.
Entchev et al., "Autonomous Perforating System for Multizone Completions," SPE 147296, Prepared for Presentation at Society of Petroleum Engineers (SPE) Annual Technical Conference and Exhibition held Oct. 30, 2011-Nov. 2, 2011, 7 pgs.
Entchev et al., Autonomous Perforating System for Multizone Completions, SPE International, 2011, 7 pgs., https://www.onepetro.org/conference-paper/SPE-147296-MS.
Federal Institute of Industrial Property; Inquiry for RU App. No. 2016104882/03(007851); dated Feb. 1, 2018; 7 pages, English Translation 4 pages.
GB Intellectual Property Office, Examination Report for GB App. No. GB1600085.3, dated Mar. 9, 2016, 1 pg.
GB Intellectual Property Office, Search Report for App. No. GB 1700625.5; dated Jul. 7, 2017; 5 pgs.
GB Intellectual Property Office; Office Action for GB App. No. 1717516.7; dated Feb. 27, 2018; 6 pages.
Halliburton; Wireline and Perforating Advances in Perforating; dated Nov. 2012; 12 pages.
Harrison Jet Gun Xtra Penetrator, website visited Nov. 29. 2018, 1 pg., https://www.google.com/search? q=harrison+jet+gun+xtra+

(56) References Cited

OTHER PUBLICATIONS penetrator&client=firefox-b-1-d&source=lnms&tbm=isch&sa=X&ved=0ahUKEwjY0KOQ1YTjAhXHmeAKHa00DeYQ_AUIESgC&biw=1440&bih=721 #imgrc=ZlqpUcJ_-TL3IM.
Hunting Titan, Inc., U.S. Appl. No. 62/736,298 titled Starburst Cluster Gun and filed Sep. 25, 2018, which is a priority application of International App. No. PCT/US2019/015255 published as International Publication No. WO2019/148009, Aug. 1, 2019, 34 pages, WIPO.
Hunting, Gun Systems and Accessories, 1 pg., http://www.hunting-intl.com/media/1976277/Wireline%20Capsule%20Gun%20Accessories.pdf.
Intellectual Property India, Office Action of IN Application No. 201647004496, dated Jun. 7, 2019, 6 pgs.
International Searchiing Authority, International Search Report and Written Opinion of International App. No. PCT/EP2019/063966, dated Aug. 30, 2019, 10 pages.
International Searching Authority, International Search and Written Opinion of International App. No. PCT/EP2020/058241, dated Aug. 10, 2020, 18 pgs.
International Searching Authority, International Search Report and Written Opinion for PCT App. No. PCT/IB2019/000526; dated Sep. 25, 2019, 17 pgs.
International Searching Authority, International Search Report and Written Opinion for PCT App. No. PCT/IB2019/000530; dated Oct. 8, 2019; 13 pgs.
International Searching Authority, International Search Report and Written Opinion for PCT App. No. PCT/IB2019/000569; dated Oct. 9, 2019, 12 pages.
International Searching Authority, International Search Report and Written Opinion of International App. No. PCT/IB2019/000569, dated Oct. 9, 2019, 12 pages.
International Searching Authority; Communication Relating to the Results of the Partial International Search for PCT/EP2020/070291; dated Oct. 20, 2020; 8 pages.
International Searching Authority; International Preliminary Report on Patentability for International Application No. PCT/IB2019/000537; dated Dec. 10, 2020; 11 pages.
International Searching Authority; International Preliminary Report on Patentability for International Application No. PCT/IB2019/000526; dated Dec. 10, 2020; 10 pages.
International Searching Authority; International Preliminary Report on Patentability for PCT Application No. PCT/IB2019/000569; dated Jan. 28, 2021; 8 pages.
International Searching Authority; International Preliminary Report on Patentability for PCT/EP2019/066919; dated Jan. 7, 2021; 9 pages.
International Searching Authority; International Preliminary Report on Patentability for PCT/B2019/000530; dated Jan. 7, 2021; 9 pages.
International Searching Authority; International Preliminary Report on Patentability International Application No. PCT/EP2019/063966; dated Dec. 10, 2020; 7 pages.
International Searching Authority; International Search Report and Written Opinion for PCT App. No. PCT/CA2014/050673; dated Oct. 9, 2014; 7 pages.
International Searching Authority; International Search Report and Written Opinion for PCT App. No. PCT/EP2019/066919; dated Sep. 10, 2019; 11 pages.
International Searching Authority; International Search Report and Written Opinion for PCT App. No. PCT/EP2019/072064; dated Nov. 20, 2019; 15 pages.
International Searching Authority; International Search Report and Written Opinion of the International Searching Authority for PCT/EP2020/070291; dated Dec. 15, 2020; 14 pages.
International Searching Authority; Invitation to Pay Additional Fees with Partial International Search for Application No. PCT/EP2020/075788; dated Jan. 19, 2021; 9 pages.
Jet Research Centers, Capsule Gun Perforating Systems, Alvarado, Texas, 26 pgs., https://www.jetresearch.com/content/dam/jrc/Documents/Books_Catalogs/07_Cap_Gun.pdf.
Norwegian Industrial Property Office; Office Action and Search Report for No. U.S. App. 20160017; dated Jun. 15, 2017; 5 pages.
SIPO, Search Report dated Mar. 29, 2017, in Chinese: See Search Report for CN App. No. 201480040456.9, 12 pgs. (English Translation 3 pgs).
United States Patent and Trademark Office, Final Office Action of U.S. Appl. No. 16/542,890, dated May 12, 2020, 16 pgs.
United States Patent and Trademark Office, Non-final Office Action of U.S. Appl. No. 16/455,816, dated Jul. 2, 2020, 15 pgs.
United States Patent and Trademark Office, Non-final Office Action of U.S. Appl. No. 16/455,816, dated Nov. 5, 2019, 17 pgs.
United States Patent and Trademark Office, Notice of Allowance for U.S. Appl. No. 16/788,107, dated Jul. 30, 2020, 9 pgs.
United States Patent and Trademark Office, Notice of Allowance of U.S. Appl. No. 16/272,326, dated Sep. 4, 2019. 9 pgs.
United States Patent and Trademark Office, Office Action of U.S. Appl. No. 16/272,326, dated May 24, 2019 17 pgs.
United States Patent and Trademark Office, Office Action of U.S. Appl. No. 16/423,230, dated Aug. 27, 2019, 16 pgs.
United States Patent and Trademark Office, Office Action of U.S. Appl. No. 16/455,816, dated Apr. 20, 2020, 21 pgs.
United States Patent and Trademark Office, Office Action of U.S. Appl. No. 16/455,816, dated Jan. 13, 2020, 14 pgs.
United States Patent and Trademark Office, Office Action of U.S. Appl. No. 16/585,790, dated Nov. 12, 2019, 9 pgs.
United States Patent and Trademark Office; Final Office Action for U.S. Appl. No. 16/451,440; dated Feb. 7, 2020; 11 pages.
United States Patent and Trademark Office; Non-Final Office Action for U.S. Appl. No. 16/379,341; dated Sep. 21, 2020; 15 pages.
United States Patent and Trademark Office; Non-Final Office Action for U.S. Appl. No. 16/542,890; dated Nov. 4, 2019; 16 pages.
United States Patent and Trademark Office; Non-Final Office Action for U.S. Appl. No. 16/542,890; dated Sep. 30, 2020; 17 pages.
United States Patent and Trademark Office; Notice of Allowance for U.S. Appl. No. 16/451,440; dated Jun. 5, 2020; 8 pages.
United States Patent and Trademark Office; Notice of Allowance for U.S. Appl. No. 16/511495; dated Dec. 15, 2020; 9 pages.
United States Patent and Trademark Office; Notice of Allowance for U.S. Appl. No. 16/455,816; dated Sep. 22, 2020; 12 pages.
United States Patent and Trademark Office; Office Action of U.S. Appl. No. 16/540,484, dated Aug. 20, 2020, 10 pgs.
Giromax Directional,Gyroscopic and magnetic borehole surveying systems with outstanding quality and reliability, Feb. 14, 2016, 4 pgs., https://www.gyromax.com.au/inertial-sensing.html.
Wikipedia, Ring Laser, Sep. 13, 2006, 13 pgs., https://en.wikipedia.org/wiki/Ring_laser.
Wikipedia, Sagnac Effect, Apr. 4, 2005, 14 pgs., https://en.wikipedia.org/wiki/Sagnac_effect.
Wikipedia, Wave Interference, Jun. 21, 2004, 11 pgs., https://en.wikipedia.org/wiki/Wave_interference.
Baker et al., Tendeka—Downhole wireless technology for production, Jul. 2018, 2 pgs., https://www.tendeka.com/wp-content/uploads/Downhole-wireless-technology-for-production-DEJ.pdf.
Halliburtion, World's first acoustic firing head system allows safer and more flexible TCP operations, Aug. 2015, 2 pgs., https://www.halliburton.com/content/dam/ps/public/lp/contents/Case_Histories/web/acoustic-firing-tcp.pdf.
Halliburton, RexConnect—Have a dialogue with your reserviour, 2015, 8 pgs., https://www.halliburton.com/content/dam/ps/public/ts/contents/Brochures/web/RezConnectBrochure.pdf.
International Searching Authority; International Preliminary Report on Patentability of the International Searching Authority for PCT/EP2019/072032; dated Mar. 4, 2021; 9 pages.
International Searching Authority; International Preliminary Report on Patentability of the International Searching Authority for PCT/EP2019/072064; dated Feb. 25, 2021; 9 pages.
International Searching Authority; International Search Report and Written Opinion of the International Searching Authority for PCT/EP2020/075788; dated Mar. 16, 2021; 17 pages.

(56) References Cited

OTHER PUBLICATIONS

AEL Intelligent Blasting, Electronic Delay Detonators, Electronic Initiators, Product Catalogue 2018, 21 pgs., https://www.aelworld.com/application/files/6915/4442/8861/ael-intelligent-blasting-differentitated-products-electronic-delay-detonators.pdf.
Albert, Larry et al.; New Perforating Switch Technology Advances Safety & Reliability for Horizontal Completions; Unconventional Resources Tech. Conference; Jul. 20-22, 2015; 7 pgs.
Allied Horizontal, Advancing Plug-and-Perf Safety and Reliability, Jul. 2015, 2 pgs, http://alliedhorizontal.com/wireline-services/perforating-services/.
AXXIS Digital Initiation System, Electronic Detonators, AXXIS Blasting Box, Apr. 28, 2019, 2 pgs., http://www.bme.co.za/products/electronic-detonators/surface/send/16-surface/27-axxis-blasting-box.
AXXIS Digital Initiation System, Electronic Detonators, AXXIS Smart Line Tester, Jun. 20, 2016, 2 pgs., http://axxis.co.za/pebble.asp?id=7.
Babu et al., Programmable Electronic Delay Device for Detonator, Defence Science Journal, May 2013, 3 pages, vol. 63, No. 3, https://doaj.org/article/848a537b12ae4a8b835391bec9.
Czech Republic Industrial Property Office; Office Action for CZ Application No. 2019549; dated Feb. 25, 2021; 3 pages.
Czech Republic Industrial Property Office; Second Office Action for CZ Application No. 2019549; dated Jul. 28, 2021; 2 pages.
Detnet, DigiShot, 6 pgs., https://www.detnet.com/application/files/4714/9969/3136/DetNet-South-Africa-DigiShot-Brochure.pdf.
DMC, Boom Times, Winter 2016 Brochure, Letter from the President & CEO, Issue 9, 2016, 3 pgs.
Dynaenergetics, Plug-N-Perf Optimized, Jul. 2016, 6 pages http://www.dynaenergetics.com/uploads/files/56e6f94760245_Product_Brochures_DynaSelect_OnlineView.pdf.
European Patent Office, Invitation to Pay Additional Fees and Partial Search Report and Written Opinion of International App No. PCT/EP2017/069327, dated Oct. 20, 2017, 14 pages.
Forcit Explosives, Daveytronic Electronic Ignition System, Sep. 13, 2019, 1 pg., https://forcit.fi/en/explosives-2/products-2/show/29/daveytronic-electronic-ignition-system.
INPI Argentina; Office Action for AR Application No. 20170102706; dated Dec. 16, 2020; 3 pages.
Intellectual Property India; First Examination Report for IN Application No. 201947035642; dated Nov. 27, 2020; 5 pages.
International Search Report and Written Opinion of International App No. PCT/EP2017/069327,which is in the same family as U.S. Appl. No. 15/499,439, dated Dec. 11, 2017, 17 pages.
Kumar et al., Delay circuit for multiple detonator, IJISET-International Journal of Innovative Science, Engineering & Tech., May 2015, 6 pages, vol. 2 Issue 5, www.ijiset.com.
Kumar et al., Novel Miniature Firing circuit for semiconductor bridge detonator initiation, Armament Res. and Dev. Establishment, Feb. 14, 2015, 4 pages, http://www.academia.edu.
Orlca, Uni Tronic 600 Electronic Blasting System, Technical Data Sheet, Jun. 19, 2016, 2 pgs., www.oricaminingservices.com/download/file_id_19567/.
The State Intellectual Property Office of P.R. China; Office Action for CN Application No. 201780082132.5; dated Mar. 5, 2021; 11 pages.
United States Patent and Trademark Office, Notice of Allowance for U.S. Appl. No. 15/499,439, dated Nov. 17, 2017, 10 pages.
United States Patent and Trademark Office, Notice of Allowance for U.S. Appl. No. 15/880,153, dated Nov. 22, 2019, 9 pages.
United States Patent and Trademark Office; Non-Final Office Action for U.S. Appl. No. 16/776,977 dated May 11, 2021; 6 pages.
United States Patent and Trademark Office; Non-Final Office Action of U.S. Appl. No. 15/499,439, dated Jul. 28, 2017; 13 pages.
United States Patent and Trademark Office; Non-Final Office Action of U.S. Appl. No. 15/880,153, dated Oct. 1, 2019 8 pages.
WIPO; Invitation to Pay Additional Fees for PCT App No. PCT/EP2017/069327; dated Oct. 20, 2017; 14 pages.
United States Patent and Trademark Office; Non-Final Office Action for U.S. Appl. No. 17/254,198; dated Dec. 22, 2021; 17 pages.
United States Patent and Trademark Office; Notice of Allowance for U.S. Appl. No. 16/924,504, dated Nov. 5, 2021; 5 pages.
European Patent Office; Rule 161 Communication for EP Application No. 20746535.2; dated Mar. 1, 2022; 3 pages.
International Searching Authority; International Preliminary Report on Patentability of the International Searching Authority for PCT/EP2020/070291; dated Feb. 3, 2022; 8 pages.
International Searching Authority; International Preliminary Report on Patentability of the International Searching Authority for PCT/EP2020/075788; dated Mar. 31, 2022; 10 pages.
United States Patent and Trademark Office; Non-Final Office Action for U.S. Appl. No. 16/919,473; dated Feb. 8, 2022; 12 pages.
United States Patent and Trademark Office; Non-Final Office Action for U.S. Appl. No. 17/072,067; dated Mar. 31, 2022; 15 pages.
United States Patent and Trademark Office; Non-Final Office Action for U.S. Appl. No. 17/608,173; dated Mar. 29, 2022; 5 pages.

* cited by examiner

SYSTEM AND METHOD FOR NAVIGATING A WELLBORE AND DETERMINING LOCATION IN A WELLBORE

STATEMENT OF RELATED APPLICATIONS

This application claims the benefit of U.S. Provisional Patent Application No. 62/831,215, filed Apr. 9, 2019. This application claims the benefit of U.S. Provisional Patent Application No. 62/823,737, filed Mar. 26, 2019. This application claims the benefit of U.S. Provisional Patent Application No. 62/720,638 filed Aug. 21, 2018. The entire contents of each application listed above are incorporated herein by reference.

FIELD OF THE DISCLOSURE

Devices, systems, and methods for navigating the downhole delivery of one or more wellbore tools in an oil or gas wellbore. More specifically, devices, systems, and methods for improving efficiency of downhole wellbore operations and minimizing debris in the wellbore from such operations.

BACKGROUND

Hydraulic Fracturing (or, "fracking") is a commonly-used method for extracting oil and gas from geological formations (i.e., "hydrocarbon formations") such as shale and tight-rock formations. Fracking typically involves, among other things, drilling a wellbore into a hydrocarbon formation; deploying a perforating gun including shaped explosive charges in the wellbore via a wireline; positioning the perforating gun within the wellbore at a desired area; perforating the wellbore and the hydrocarbon formation by detonating the shaped charges; pumping high hydraulic pressure fracking fluid into the wellbore to force open perforations, cracks, and imperfections in the hydrocarbon formation; delivering a proppant material (such as sand or other hard, granular materials) into the hydrocarbon formation to hold open the perforations and cracks through which hydrocarbons flow out of the hydrocarbon formation; and, collecting the liberated hydrocarbons via the wellbore.

In oil and gas wells, a wellbore 16, as illustrated in FIG. 1 is a narrow shaft drilled in the ground, vertically and/or horizontally deviated. A wellbore 16 can include a substantially vertical portion as well as a substantially horizontal portion and a typical wellbore may be over a mile in depth (e.g., the vertical portion) and several miles in length (e.g., the horizontal portion). The wellbore 16 is usually fitted with a wellbore casing that includes multiple segments (e.g., about 40-foot segments) that are connected to one another by couplers. A coupler (e.g., a collar), may connect two sections of wellbore casing.

In the oil and gas industry, a wireline, electric line or e-line are cabling technology used to lower and retrieve equipment or measurement devices into and out of the wellbore 16 of an oil or gas well for the purpose of delivering an explosive charge, evaluation of the wellbore 16 or other well-related tasks. Other methods include tubing conveyed (i.e., TCP for perforating) or coil tubing conveyance. A speed of unwinding a wireline cable 12 and winding the wireline cable back up is limited based on a speed of the wireline equipment 162 and forces on the wireline cable 12 itself (e.g., friction within the well). Because of these limitations, it typically can take several hours for a wireline cable 12 and toolstring 31 to be lowered into a well and another several hours for the wireline cable to be wound back up and the expended toolstring retrieved. The wireline equipment 162 feeds wireline 12 through wellhead 160. When detonating explosives, the wireline cable 12 will be used to position a toolstring 31 of perforating guns 18 containing the explosives into the wellbore 16. After the explosives are detonated, the wireline cable 12 will have to be extracted or retrieved from the well.

Wireline cables and TCP systems have other limitations such as becoming damaged after multiple uses in the wellbore due to, among other issues, friction associated with the wireline cable rubbing against the sides of the wellbore. Location within the wellbore is a simple function of the length of wireline cable that has been sent into the well. Thus, the use of wireline may be a critical and very useful component in the oil and gas industry yet also presents significant engineering challenges and is typically quite time consuming. It would therefore be desirable to provide a system that can minimize or even eliminate the use of wireline cables for activity within a wellbore while still enabling the position of the downhole equipment, e.g., the toolstring 31, to be monitored.

During many critical operations utilizing equipment disposed in a wellbore, it is important to know the location and depth of the equipment in the wellbore at a particular time. When utilizing a wireline cable for placement and potential retrieval of equipment, the location of the equipment within the well is known or, at least, may be estimated depending upon how much of the wireline cable has been fed into the wellbore. Similarly, the speed of the equipment within the wellbore is determined by the speed at which the wireline cable is fed into the wellbore. As is the case for a toolstring 31 attached to a wireline, determining depth, location and orientation of a toolstring 31 within a wellbore 16 is typically a prerequisite for proper functioning.

One known means of locating an toolstring 31, whether tethered or untethered, within a wellbore involves a casing collar locator ("CCL") or similar arrangement, which utilizes a passive system of magnets and coils to detect increased thickness/mass in the wellbore casing 80 at portions where the coupling collars 90 connect two sections of wellbore casing 82, 84. A toolstring 31 equipped with a CCL may be moved through a portion of wellbore casing 80 having a collar 90. The increased wellbore wall thickness/mass at collar 90 results in a distortion of the magnetic field (flux) around the CCL magnet. This magnetic field distortion, in turn, results in a small current being induced in a coil; this induced current is detected by a processor/onboard computer which is part of the CCL. In a typical embodiment of known CCL, the computer 'counts' the number of coupling collars 90 detected and calculates a location along the wellbore 16 based on the running count.

Another known means of locating a toolstring 31 within a wellbore 16 involves tags attached at known locations along the wellbore casing 80. The tags, e.g., radio frequency identification ("RFID") tags, may be attached on or adjacent to casing collars but placement unrelated to casing collars is also an option. Electronics for detecting the tags are integrated with the toolstring 31 and the onboard computer may 'count' the tags that have been passed. Alternatively, each tag attached to a portion of the wellbore may be uniquely identified. The detecting electronics may be configured to detect the unique tag identifier and pass this information along to the computer, which can then determine current location of the toolstring 31 along the wellbore 16.

Knowledge of the location, depth and velocity of the toolstring in the absence of a wireline cable would be essential. The present disclosure is further associated with systems and methods of determining location along a wellbore 16 that do not necessarily rely on the presence of casing collars or any other standardized structural element, e.g., tags, associated with the wellbore casing 80.

BRIEF SUMMARY OF THE DISCLOSURE

The systems and methods described herein have various benefits in the conducting of oil and gas exploration and production activities.

A wellbore navigation system includes an ultrasound transceiver configured to transmit an ultrasound signal and receive a return signal and a processor programmed to monitor the return signal to identify a point along the wellbore. The processor is configured to identify the point by recognizing a change in the return signal compared to a base return signal. The point along the wellbore represents a substantial change in physical parameters from a set of adjacent points in the wellbore. The point along the wellbore may be a feature selected from the group including a casing collar, a wellbore casing, a gap between adjacent wellbore casings, a thread joining the casing collar to the wellbore casing, an anomalous variation in the wellbore casing and a geological formation external to the wellbore casing.

The wellbore navigation system may include a transmitting element that transmits the ultrasound signal and a receiving element that receives the return signal. In an embodiment, a wellbore navigation system may include a first ultrasonic transceiver configured to transmit a first ultrasound signal and receive a first return signal and a second ultrasonic transceiver configured to transmit a second ultrasound signal and receive a second return signal. The first and second ultrasonic transceivers may be arranged so as to successively traverse a given portion of a wellbore. A processor may be programmed to monitor the first return signal to identify a point along the wellbore and to monitor the second return signal to identify the same point along the wellbore. This processor may be programmed to calculate a velocity of the first and second ultrasonic transceivers through the wellbore based on a time difference between identification of the point by the first return signal and identification of the same point by the second return signal. The processor may also be programmed to utilize one or more of the time differences between identification of a plurality of points by the first return signal and identification of a plurality of points by the second return signal to determine a position of the navigation system in the wellbore. The processor may also be programmed to calculate and store a set of topology data for a plurality of alterations in the return signal for the wellbore.

In an embodiment, the wellbore navigation system described may be a component of an untethered drone assembly sized to travel through a wellbore, i.e., the wellbore navigation system may be integral to the untethered drone assembly. The untethered drone assembly may have a body axis substantially coaxial with the wellbore, the first and second ultrasonic transceivers being displaced with respect to one another along the drone body axis.

The wellbore navigation system may also include an electronic filter associated with the processor, the filter configured to remove noise from each of the return signals.

In a further embodiment, an untethered drone may be configured for insertion into a wellbore, the untethered drone includes a drone body having a distal end, a proximal end and a body axis that is substantially coaxial with an axis of the wellbore. The drone also includes a navigation system which includes a first ultrasonic transceiver configured to transmit a first ultrasound signal and receive a first return signal and a second ultrasonic transceiver configured to transmit a second ultrasound signal and receive a second return signal. The first and second ultrasonic transceivers are axially displaced with respect to one another along the body axis so as to successively traverse each point of the wellbore. A processor in the drone is programmed to monitor the first return signal to identify a point along the wellbore and to monitor the second return signal to identify the point along the wellbore. The first ultrasonic transceiver may be located adjacent the distal end of the drone and the second transceiver may be located adjacent the proximal end of the drone.

A method of determining a location of an untethered drone along a wellbore is also presented herein. The method includes the steps of inserting an untethered drone into the wellbore, the drone having a drone body, a body axis that is substantially coaxial with an axis of the wellbore, a distal end and a proximal end disposed along the body axis and providing a navigation system integral with the drone body. The navigation system includes a first ultrasonic transceiver and a second ultrasonic transceiver axially displaced with respect to one another along the body axis so as to successively traverse a portion of the wellbore and a processor. The method may also include the steps of initially identifying a point along the wellbore by transmitting a first ultrasound signal and receiving a first return signal with the first ultrasonic transceiver and processing the first return signal with the processor and secondarily identifying the point along the wellbore by transmitting a second ultrasound signal and receiving a second return signal with the second ultrasonic transceiver and processing the second return signal with the processor.

In an embodiment, the method may be accomplished wherein the first ultrasonic transceiver is located adjacent the distal end of the drone and the second ultrasonic transceiver is located adjacent the proximal end of the drone. Another step in the method may include calculating a velocity of the untethered drone through the wellbore by calculating with the processor a time difference between the initially identifying step and the secondarily identifying step or determining the position of the untethered drone in the wellbore by calculating with the processor one or more time differences between the initially identifying step and the secondarily identifying step. Other optional steps may include calculating with the processor, a set of topology data for a plurality of points identified along the wellbore and storing the set of topology data. A further step that may be included is that of filtering a first and second return signals to remove electronic noise.

In an embodiment of the method, the first identifying step and the second identifying step may concern a feature selected from the group comprising a casing collar, a wellbore casing, a gap between adjacent the wellbore casings, a thread joining the casing collar to the wellbore casing, an anomalous variation in the wellbore casing and a geological anomaly external to the wellbore casing.

In a separate embodiment described herein, a wellbore navigation system includes an electromagnetic field generator and monitor, the monitor detects any interference in a field generated by the electromagnetic field generator to identify at least one of a velocity and a distance traveled from an entry point of the wellbore navigation system. The system may include an oscillator circuit as part of the electromagnetic field generator, the oscillator circuit generating variable frequencies in order to improve resolution on the monitor and the variable frequencies determined dynamically based on the determined velocity of the wellbore navigation system.

The wellbore navigation system may include a first wire coil wound around a first core and a second wire coil wound around a second core, the first and second cores having high magnetic permeability. An oscillator circuit is connected to each of the first wire coil and the second wire coil, the oscillator circuit generating a first resonant frequency on the first coil and a second resonant frequency on the second coil. Each of the first and second resonant frequencies will be a function of the physical characteristics of materials immediately external to the respective wire coil. The first and second wire coils are arranged so as to successively traverse a given portion of a wellbore. A processor/computer programmed to monitor the first resonant frequency and second resonant frequency for any alteration is electrically attached to the wire coils and/or the oscillator circuit.

The processor of the wellbore navigation system may be programmed to calculate a velocity based on the movement of the first and second coil through the wellbore based on a time difference between the alteration of the first resonant frequency and the second resonant frequency. Also, the processor may be programmed to utilize one or more time differences between alteration of the first and second resonant frequencies to determine the position of the navigation system in the wellbore. The processor or the wellbore navigation system may be programmed to calculate and store a full set of topology data for all alterations in resonant frequencies for the wellbore.

The oscillator circuit of the wellbore navigation system may comprise an oscillator and a capacitor.

The wellbore navigation system may be an integral part of an untethered drone assembly sized to travel through a wellbore. The untethered drone assembly has an axis substantially coaxial with the wellbore. The first and second wire coils are each coaxial with the drone assembly axis and displaced with respect to one another along the drone assembly axis.

The alteration of the resonant frequencies in the wellbore navigation system may be the result of distortion of a magnetic field surrounding the coils, the distortion resulting from at least one of a casing collar, a transition from a wellhead to a wellbore pipe, a geologic formation, a variation in the diameter of the wellbore, a defect in any wellbore element and a wellbore structural element.

The wellbore into which the navigation system is inserted may include a steel pipe having an inner diameter and an outer diameter. The resonant frequencies of the system may be tuned to the geometry of the steel pipe.

The first and second cores of the navigation system may be of a ferromagnetic material such as ferrite, laminated iron or iron powder.

The wellbore navigation system may also include an amplifier and an electronic filter associated with the oscillator circuit or the processor. The amplifier reinforces a signal developed from the alterations in the resonant frequencies and the filter removes noise from the signal.

Also disclosed is an untethered drone for insertion into a wellbore, the untethered drone has a drone body with a distal end, a proximal end and a body axis that is substantially coaxial with an axis of the wellbore. A navigation system is part of the drone and includes a first wire coil wound around a first core and a second wire coil wound around a second core, the first and second core having high magnetic permeability. An oscillator circuit is connected to each of the first wire coil and the second wire coil, the oscillator circuit generating a first resonant frequency on the first coil and a second resonant frequency on the second coil. Each of the first and second resonant frequencies may be a function of the physical characteristics of materials immediately external to the respective wire coil. The first and second wire coils are coaxial with the body axis of the drone and displaced with respect to one another along the body axis so as to successively traverse a given portion of the wellbore. A processor programmed to monitor the first resonant frequency and second resonant frequency for any alteration. The first wire coil may be located adjacent the distal end of the drone and the second wire coil may be located adjacent the proximal end of the drone.

The processor/onboard computer of the untethered drone may be programmed to calculate a velocity of the first and second coil through the wellbore based on a time difference between the alteration of the first resonant frequency and the second resonant frequency.

The drone's navigation system may also include an amplifier and an electronic filter associated with the oscillator circuit or the processor. The amplifier reinforces a signal developed from the alterations in the resonant frequencies and the filter removes noise from the signal.

Also disclosed herein is a method of determining a location and/or velocity of an untethered drone along a wellbore, the method comprising several steps. One step of the method involves inserting an untethered drone body into the wellbore, the drone body having a body axis that is substantially coaxial with an axis of the wellbore, a distal end and a proximal end disposed along the body axis. Another step in the method involves providing a navigation system that is integral with the drone body. The navigation system includes a first wire coil wound around a first core and a second wire coil wound around a second core, the first and second core having high magnetic permeability. The first and second wire coils are coaxial with the body axis of the drone and displaced with respect to one another along the body axis so as to successively traverse a given portion of the wellbore. An oscillator circuit connected to each of the first wire coil and the second wire coil and a processor/onboard computer is attached to the oscillator circuit and the wire coils. Another step involves utilizing the oscillator circuit to generate a first resonant frequency on the first coil and a second resonant frequency on the second coil; each of the first and second resonant frequencies is a function of the physical characteristics of materials immediately external to the respective wire coil and adjacent sections of the drone. Another step of the method involves determining any alteration in the first resonant frequency and second resonant frequency utilizing the processor/onboard computer.

The method may also include the first wire coil being located adjacent the distal end of the drone and the second wire coil being located adjacent the proximal end of the drone. Another step in the method involves calculating a velocity of the untethered drone through the wellbore based on a time difference between the alteration of the first resonant frequency and the second resonant frequency and the axial displacement of the first and second coils with respect to one another. The method may also include the step of determining the position of the untethered drone in the wellbore utilizing the processor by determining one or more time differences between alteration of the first and second resonant frequencies. Similarly, the method may include the steps of calculating, utilizing the processor, a full set of topology data for all alterations in resonant frequencies for the wellbore; and storing the full set of topology data.

The method described can involve the alteration of the resonant frequencies being the result of distortion of a magnetic field surrounding the coils, the distortion resulting from at least one of a geologic formation, a variation in the diameter of the wellbore, a defect in any wellbore element, a casing collar or other wellbore structural element. Further, the method may involve the wellbore having a steel pipe of a geometry and the resonant frequencies being tuned to the geometry of the steel pipe. The steel pipe geometry may comprise an inner diameter and an outer diameter.

The method described can have first and second cores of a ferromagnetic material such as ferrite, laminated iron or iron powder. The method may include the step of amplifying a signal developed from the alterations in the resonant frequencies; and the step of filtering the signal to remove electronic noise.

A composite or hybrid wellbore navigation system may also be formed from the disclosures presented herein. The hybrid wellbore navigation system may include an ultrasound transceiver configured to transmit an ultrasound signal and receive a return signal combined with a wire coil wound around a core, the core having high magnetic permeability. An oscillator circuit may be connected to the wire coil, the oscillator circuit generating a resonant frequency on the wire coil, wherein the resonant frequency being a function of physical characteristics of materials immediately external to the wire coil. A processor may be programmed to monitor the return signal and programmed to monitor the first resonant frequency. The processor may be configured to utilize the return signal to determine a point along the wellbore and also configured to utilize an alteration in the resonant frequency to detect the point.

The hybrid wellbore navigation system may detect the point along the wellbore that is a casing collar, a wellbore casing, a gap between the adjacent wellbore casings, a thread joining the casing collar to the wellbore casing, an anomalous variation in the wellbore casing or a geological formation external to the wellbore casing.

In an embodiment, a hybrid wellbore navigation system may include a first ultrasonic transceiver configured to transmit a first ultrasound signal and receive a first return signal and a second ultrasonic transceiver configured to transmit a second ultrasound signal and receive a second return signal. The first and second ultrasonic transceivers may be arranged so as to successively traverse a portion of a wellbore. This navigation system may also include a first wire coil wound around a first core and a second wire coil wound around a second core, the first and second cores having high magnetic permeability. The first and second wire coils may be arranged so as to successively traverse the same portion of the wellbore. An oscillator circuit connected to each of the first wire coil and the second wire coil, the oscillator circuit generating a first resonant frequency on the first coil and a second resonant frequency on the second coil with each of the first and second resonant frequencies being a function of physical characteristics of materials immediately external to the respective wire coil. A processor is programmed to monitor the first return signal, to monitor the second return signal, to monitor the first resonant frequency and to monitor the second resonant frequency. The processor may also be configured to utilize one or both of the first return signal and the second return signal to identify a point along the wellbore. The processor may also be configured to utilize an alteration in one or both of the first resonant frequency and the second resonant frequency to detect the point.

In an embodiment, the processor of the untethered drone is programmed to calculate a velocity of the navigation system through the wellbore based on a time difference between identification of the point determined from the first return signal and identification of the point determined from the second return signal. The processor may also be programmed to calculate a velocity of the navigation system through the wellbore based on a time difference between identification of the point determined from the alteration of the first resonant frequency and identification of the point determined from the alteration of the second resonant frequency. The untethered drone processor may also be programmed to calculate and store a set of topology data for identification of a plurality of the points for the wellbore.

A method of determining a location of an untethered drone along a wellbore is also described herein. The method may include the steps of inserting an untethered drone into the wellbore, the drone having a drone body, a body axis that is substantially coaxial with an axis of the wellbore, a distal end and a proximal end disposed along the body axis and providing a navigation system integral with the drone body. The provided navigation system may include a first ultrasonic transceiver and a second ultrasonic transceiver axially displaced with respect to one another along the body axis so as to successively traverse a portion of the wellbore; a first wire coil wound around a first core and a second wire coil wound around a second core, the first and second core having high magnetic permeability, the first and second wire coils are coaxial with the body axis of the drone and displaced with respect to one another along the body axis so as to successively traverse the portion of the wellbore; an oscillator circuit connected to each of the first wire coil and the second wire coil; and a processor. The method utilizes the provided navigation system in generating a first resonant frequency on the first coil and a second resonant frequency on the second coil utilizing the oscillator circuit, wherein each of the first and second resonant frequencies is a function of the physical characteristics of materials immediately external to the respective wire coil. The method continues in determining an alteration in the first resonant frequency and second resonant frequency utilizing the processor; initially identifying a point along the wellbore by transmitting a first ultrasound signal from the first ultrasonic transceiver, receiving a first return signal with the first ultrasonic transceiver and processing the first return signal with the processor; and secondarily identifying the point along the wellbore by transmitting a second ultrasound signal from the second ultrasonic transceiver, receiving a second return signal with the second ultrasonic transceiver and processing the second return signal with the processor.

BRIEF DESCRIPTION OF THE SEVERAL VIEWS OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
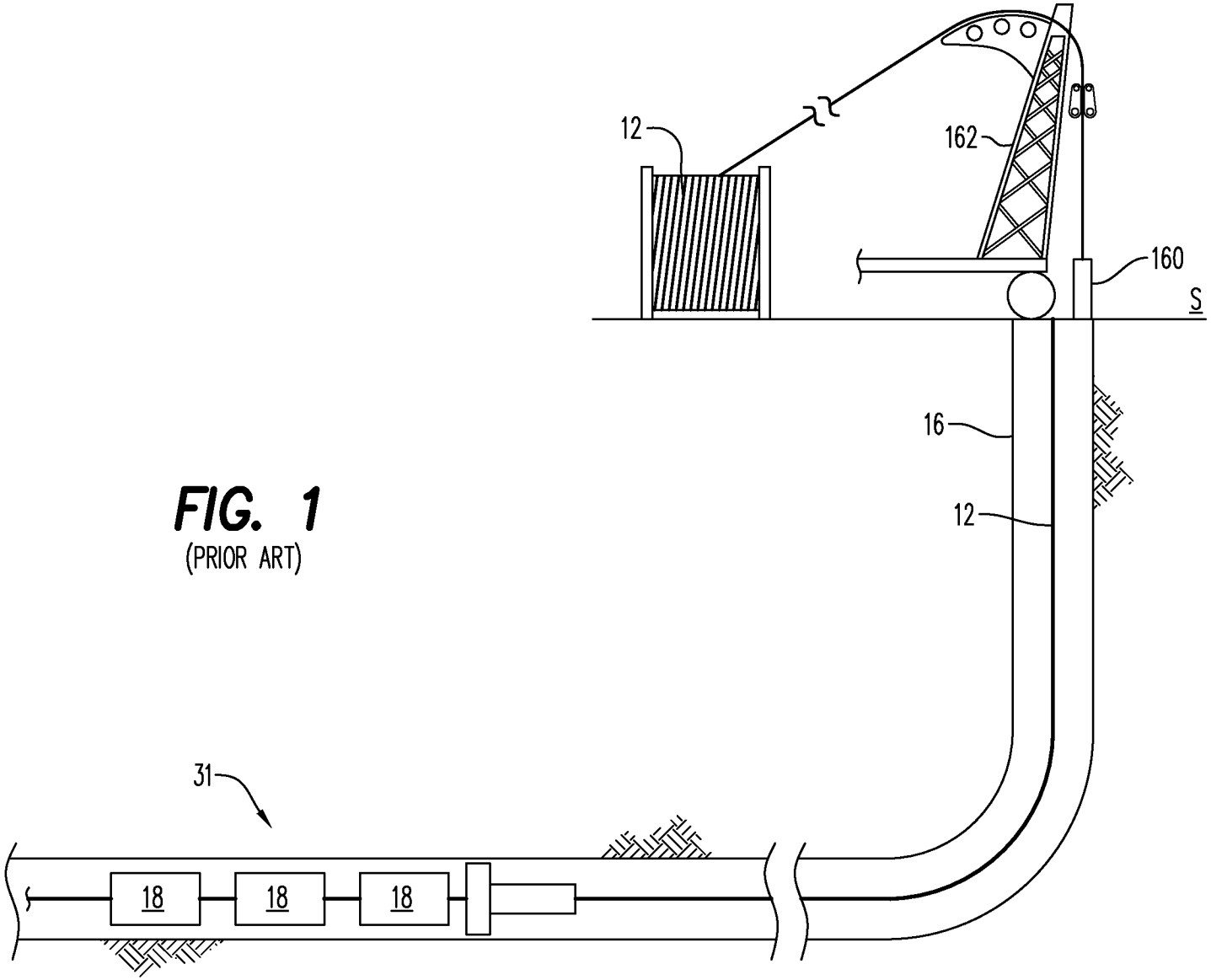
FIG. 1 (PRIOR ART)
FIG. 1 is a cross-sectional view of a wellbore and wellhead showing the prior art use of a wireline to place drones in a wellbore.

Various features, aspects, and advantages of the embodiments will become more apparent from the following detailed description, along with the accompanying figures in which like numerals represent like components throughout the figures and text. The various described features are not necessarily drawn to scale but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION OF THE EXEMPLARY EMBODIMENTS

Reference will now be made in detail to various exemplary embodiments. Each example is provided by way of explanation and is not meant as a limitation and does not constitute a definition of all possible embodiments.

As used herein, the term "anomaly" means an alteration in the physical characteristics in a particular area that will likely result in a changed signal received by a device traversing the particular area while actively or passively monitoring physical characteristics around said device. For example, in the event the device is travelling through a wellbore casing while monitoring the physical characteristics surrounding said device, structures such as a casing collar, a gap between adjacent wellbore casings, a thread joining the casing collar to the wellbore casing, an anomalous variation in the wellbore casing and a geological anomaly external to the wellbore casing, may cause a change in the signal(s) being monitored by the device. Each such structures would be considered an anomaly and the point along the path of the device where the signals are changed is referred to as an "anomalous point".

For purposes of this disclosure, an "untethered drone" is a self-contained, autonomous or semi-autonomous vehicle for downhole delivery of a wellbore tool that does not need to be tethered to a wireline in order for the wellbore tool to achieve its downhole function(s). More than one untethered drone may be connected together in a toolstring. The term "autonomous" means that the untethered drone is capable of performing its fuction(s) in the absence of receiving any instructions or signals after launch. The term "semi-autonomous" means that the untethered drone is capable of receiving instructions or signals after launch.

As mentioned above, one form of a wellbore tool is a perforating gun. It is contemplated that an untethered drone may include any wellbore tools, including but not limited to a perforation gun, puncher gun, logging tool, jet cutter, plug, frac plug, bridge plug, setting tool, self-setting bridge plug, self-setting frac plug, mapping/positioning/orientating tool, bailer/dump bailer tool and ballistic tool. Commonly owned U.S. Provisional App. No. 62/765,185, filed Aug. 20, 2018, which is incorporated herein in its entirety by reference, discloses an untethered drone.

This application incorporates by reference each of the following pending patent applications in their entireties: International Patent Application No. PCT/US2019/063966, filed May 29, 2019; U.S. patent application Ser. No. 16/423,230, filed May 28, 2019; U.S. Provisional Patent Application No. 62/842,329, filed May 2, 2019; U.S. Provisional Patent Application No. 62/841,382, filed May 1, 2019; International Patent Application No. PCT/IB2019/000526, filed Apr. 12, 2019; U.S. Provisional Patent Application No. 62/831,215, filed Apr. 9, 2019; International Patent Application No. PCT/IB2019/000530, filed Mar. 29, 2019; International Patent Application No. PCT/IB2019/000537, filed Mar. 18, 2019; U.S. Provisional Patent Application No. 62/816,649, filed Mar. 11, 2019; U.S. Provisional Patent Application No. 62/765,185, filed Aug. 16, 2018; U.S. Provisional Patent Application No. 62/719,816, filed Aug. 20, 2018; U.S. Provisional Patent Application No. 62/690,314, filed Jun. 26, 2018; U.S. Provisional Patent Application No. 62/678,654, filed May 31, 2018; and U.S. Provisional Patent Application No. 62/678,636, filed May 31, 2018.

Figure 2A:
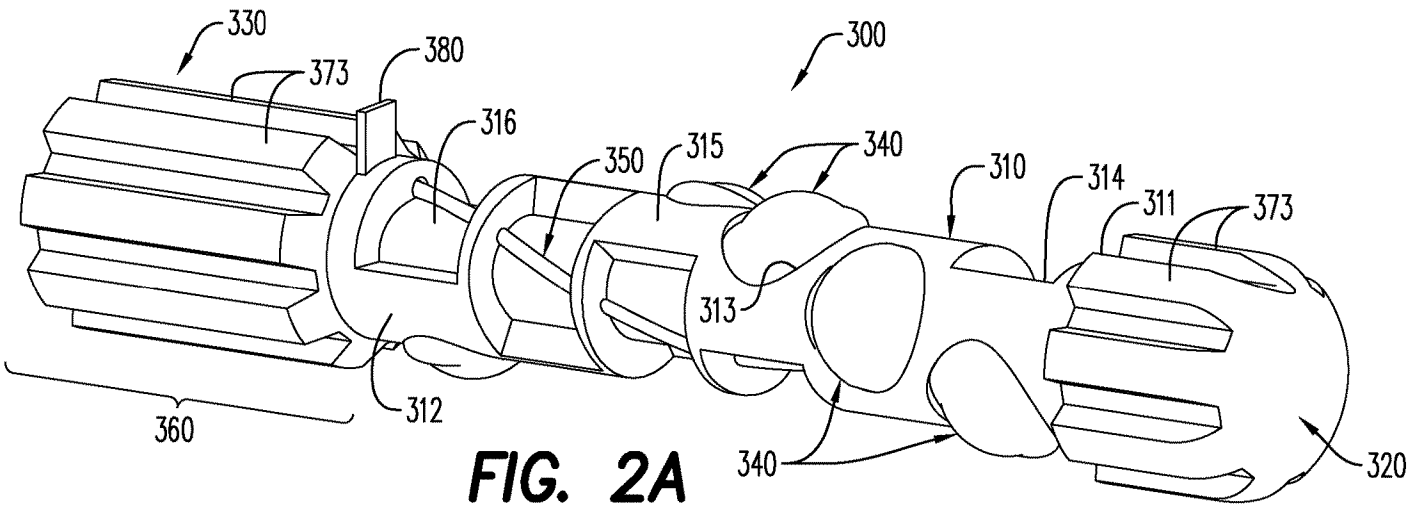
FIG. 2A is a perspective view of a drone in the form of a perforating gun.
Figure 2B:
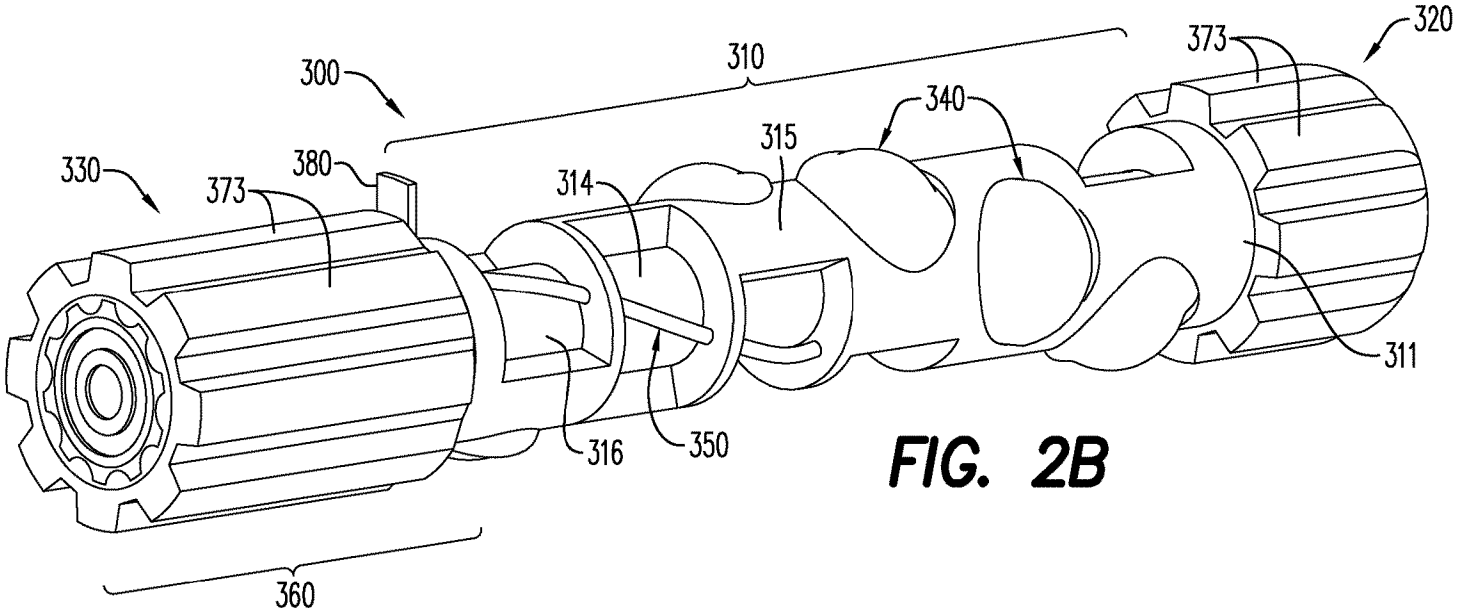
FIG. 2B is different perspective view of the drone of FIG. 2A.

With reference to FIGS. 2A and 2B, an exemplary embodiment is shown of an untethered drone 300 in the particular configuration of a perforating gun. As described herein, the untethered drone 300 may be launched autonomously or semi-autonomously into a wellbore 16, for delivering one or more wellbore tools downhole. The wellbore tool illustrated in FIGS. 2A and 2B is a perforating gun including a plurality of shaped charges 340. According to an aspect, the perforating gun may be connected to other wellbore tools, such as a bridge plug and a frac plug.

The exemplary untethered drone 300 shown in FIGS. 2A and 2B includes a body portion 310 having a front end 311 and a rear end 312. A head portion 320 extends from the front end 311 of the body portion 310 and a tail portion 330 extends from the rear end 312 of the body portion 310 in a direction opposite the head portion 320. It is to be noted here that the elimination of a tether in untethered drone 300, typically in the form of wireline cable 12, removes one of the key distinctions between the structure of the head portion 320 and tail portion 330. That is, an untethered drone does not include a tethering point on the tail portion. The absence of a tethering point offers the opportunity of loading either the head portion 320 or tail portion 330 first into the wellbore 16. Further, the head portion 320 and tail portion 330 could be essentially identical and loading direction of the drone rendered arbitrary. Further, an onboard computer/vehicle driver for powering and/or controlling the autonomous operation of the untethered drone 300 may be located in whole or variously in either the head portion 320 or the tail portion 330 depending on particular applications.

The body portion 310 of untethered drone 300, when in the form of a perforating gun, may include a plurality of shaped charge apertures 313 and open apertures 316 extending between an external surface 315 of the body portion 310 and an interior 314 of the body portion 310. Each of the plurality of shaped charge apertures 313 are configured for receiving and retaining a shaped charge 340. A detonating cord 350 for detonating the shaped charges 340 and relaying ballistic energy along the length of the untethered drone 300 may be housed within at least a portion of each of the body portion 310, the head portion 320, and the tail portion 330. The detonating cord 350 may be configured as a conductive detonating cord and, additionally, for conveying non-detonation electrical signals, as described in U.S. Provisional Application No. 62/683,083 (filed Jun. 11, 2018), which is incorporated herein in its entirety.

The body portion 310, the head portion 320, and the tail portion 330 may be an injection-molded plastic or any other suitable material. Other such materials and associated methods of manufacture include casting (e.g., plastic casting and resin casting), metal casting, 3D printing, and 3D milling from a solid bar stock. Reference to the exemplary embodiments including injection-molded plastics is thus not limiting. An untethered drone 300 formed according to this disclosure leaves a relatively small amount of debris in the wellbore post perforation. Further, the materials may include metal powders, glass beads or particles, known proppant materials, and the like that may serve as a proppant material when the shaped charges 340 are detonated. In addition, the materials may include, for example, oil or hydrocarbon-based materials that may combust and generate pressure when the shaped charges 340 are detonated, synthetic materials potentially including a fuel material and an oxidizer to generate heat and pressure by an exothermic reaction, and materials that are dissolvable in a hydraulic fracturing fluid.

In the exemplary disclosed embodiments, the body portion 310 is a unitary structure that may be formed from an injection-molded material. In the same or other embodiments, at least two of the body portion 310, the head portion 320, and the tail portion 330 are integrally formed from an injection-molded material. In other embodiments, the body portion 310, the head portion 320, and the tail portion 330 may constitute modular components or connections.

Each of the body portion 310, the head portion 320, and the tail portion 330 is substantially cylindrically-shaped and may include a central cavity in which various drone components may be located. The relationship between the outer shell and central cavity may be such that the internal components of the untethered drone 300 are protected from exposure to the contents and conditions of the wellbore 16, e.g., high temperature and fluid pressures, during the descent of the untethered drone 300 into the wellbore 16. Each of the head portion 320 and the tail portion 330 may include fins 373 configured for, e.g., reducing friction and inducing rotational speed during the descent of the untethered drone 300 into the wellbore 16.

With continuing reference to FIGS. 2A and 2B, each of the plurality of shaped charge apertures 313 in the body portion 310 may receive and retain a portion of a shaped charge 340 in a corresponding hollow portion (unnumbered) of the interior 314 of the body portion 310. Another portion of the shaped charge 340 remains exposed to the surrounding environment. Thus, the body portion 310 may be considered in some respects as an exposed charge carrier, and the shaped charges 340 may be encapsulated, pressure sealed shaped charges having a lid or cap. The plurality of open apertures 316 may be configured for, among other things, reducing friction against the body portion 310 as the untethered drone 310 is conveyed into a wellbore 16 and/or for enhancing the collapse/disintegration properties of the body portion 310 when the shaped charges 340 are detonated.

The interior 314 of the body portion 310 may have hollow regions and non-hollow regions. The hollow portion of the interior 314 may include one or more structures for supporting each of the shaped charge 340 in the shaped charge apertures 313. The supporting structure may support, secure, and/or position the shaped charge 340 and may be formed from a variety of materials in a variety of configurations consistent with this disclosure. For example and without limitation, the supporting structure may be formed from the same material as the body portion 310 and may include a retaining device such as a retaining ring, clip, tongue in groove assembly, frictional engagement, etc., and the shaped charge 340 may include a complimentary structure to interact with the supporting structure.

In an aspect and with continuing reference to FIGS. 2A and 2B, the body portion 310, head portion 320 and tail portion 310 of the untethered drone 300 may house a line (not shown) for relaying electrical current and/or signals along the length of the untethered drone 300, as discussed further below. The untethered drone 300 may also include a deactivating safety device 380 that must be actuated or removed prior to certain operations/functions of the drone being enabled.

Ultrasonic transducers are a type of acoustic sensor that may include both a transmitter of ultrasound signals and a receiver of ultrasound signals. When both are included in a single ultrasound transducer, the unit is referred to as a transceiver. An ultrasound transmitter converts electrical signals into an ultrasound signal and directs the ultrasound signal in one or more directions. Ultrasound receivers have an element that receives an ultrasound signal and converts ultrasound waves received into electrical signals. There are several ways the transmitter and receiver parts can be oriented on the transducer; they can be on opposite ends of the transducers, or both devices can be located on the same end and same side. A computer/processor associated with the ultrasound transducer may be programmed to both produce the transmitted ultrasound signal and interpret the received ultrasound signal. Similar to radar and sonar, ultrasonic transducers evaluate targets by directing sound waves at the target and interpreting the reflected signals.

Figure 3B:
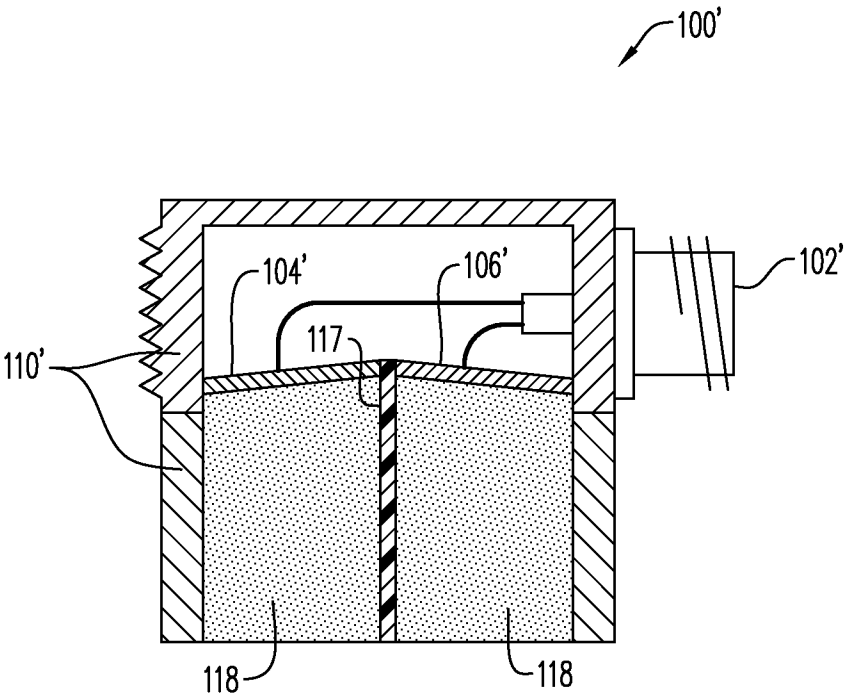
FIG. 3B is a cross-sectional, side plan view of an ultrasonic transceiver utilized in an embodiment.
Figure 3A:
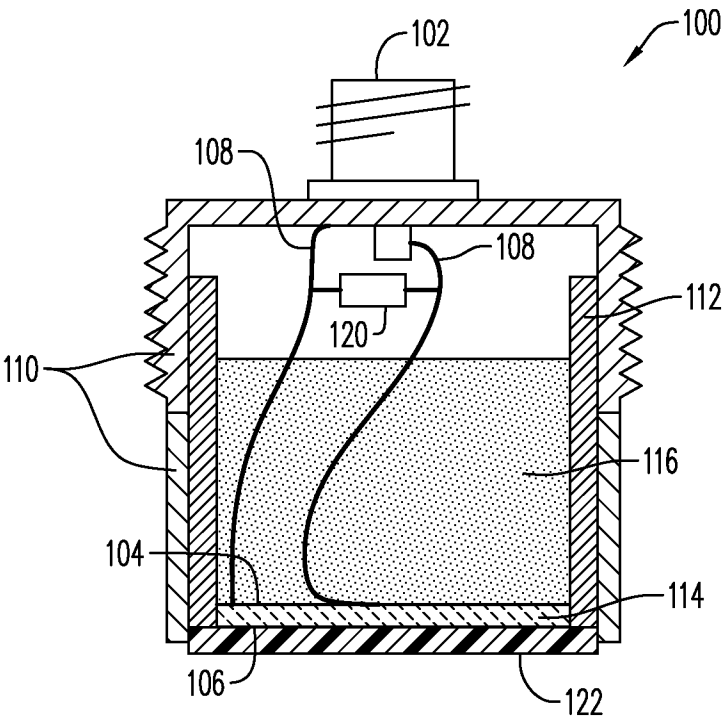
FIG. 3A is a cross-sectional, side plan view of an ultrasonic transceiver utilized in an embodiment.

FIG. 3A is a cross-section of an ultrasonic transducer 100 that may be used in a system and method of determining location along a wellbore 16 (as seen, for instance, in FIG. 1). The transducer 100 may include a housing 110 and a connector 102; the connector 102 is the portion of the housing 110 allowing for connections to the computer/processor (see, for instance, FIG. 4) that generates and interprets the ultrasound signals. The key elements of the transducer 100 are the transmitting element 104 and the receiving element 106 that are contained in the housing 110. In the transducer shown in FIG. 3A, the transmitting/receiving elements 104/106 are integrated into a single active element 114. That is, active element 114 is configured to both transmit an ultrasound signal and receive an ultrasound signal. Electrical leads 108 are connected to electrodes on the active element 114 and convey electrical signals to/from the computer/processor. An electrical network 120 may be connected between the electrical leads 108 for purposes of matching electrical impedance and other signal processing requirements of ultrasound equipment. Optional elements of a transducer include a sleeve 112, backing 116 and a cover/wearplate 122 protecting the active element 114.

FIG. 3B is a cross-section of an alternative version of an ultrasonic transducer 100' that may be used in a system and method of determining location along a wellbore 16. The transducer 100' may include a housing 110' and a connector 102'; the connector 102' is the portion of the housing 110' allowing for connections to the computer/processor that generates and interprets the ultrasound signals. The key elements of the transducer 100' are the transmitting element 104' and the receiving element 106' that are contained in the housing 110'. A delay material 118 and an acoustic barrier 117 are provided for improving sound transmission and receipt in the context of a separate transmitting element 104 and receiving element 106 apparatus.

Figure 4:
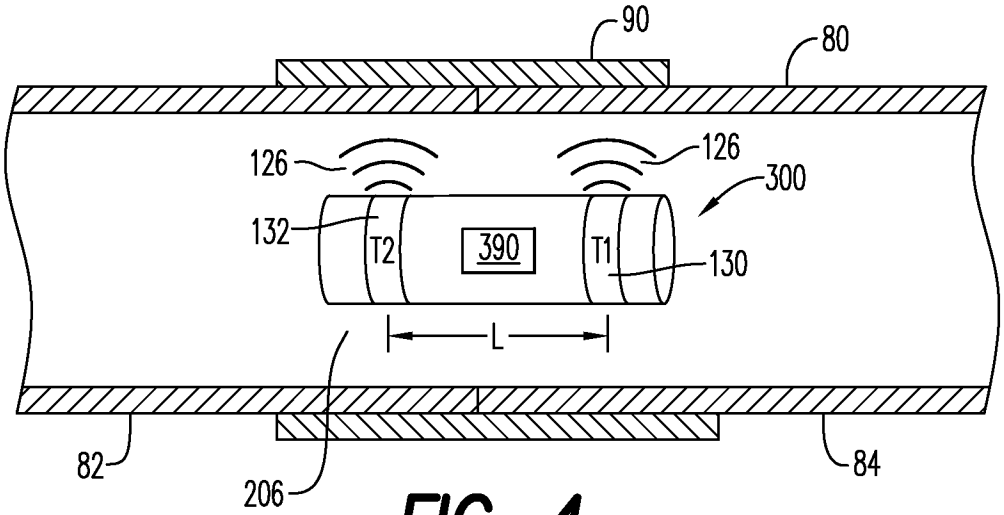
FIG. 4 is a cross-sectional plan view of a two ultrasonic transceiver based navigation system of an embodiment.

Ultrasonic transducers 100 may be used to determine the speed of an untethered drone 300 traveling down a wellbore 16 by identifying ultrasonic waveform changes. As depicted in FIG. 4, an untethered drone 300 may be equipped with one or more ultrasonic transducers 100. In an embodiment, the untethered drone 300 has a first transducer 130 (also marked T1) and a second transducer 132 (also marked T2), one at each end of the untethered drone 300. The distance separating the first transducer 130 from the second transducer 132 is a constant and may be referred to as distance 'L'. Each transducer 130, 132 may have a transmitting element 104 and a receiving element 106 (as shown in FIGS. 3A and 3B) that sends/receives signals radially from the untethered drone 300. In an embodiment, each transmitting element 104 and receiving element 106 may be disposed about an entire radius of the untethered drone 300; such an arrangement permits the elements 104, 106 to send/receive signals about essentially the entire radius of the untethered drone 300.

Figure 5:
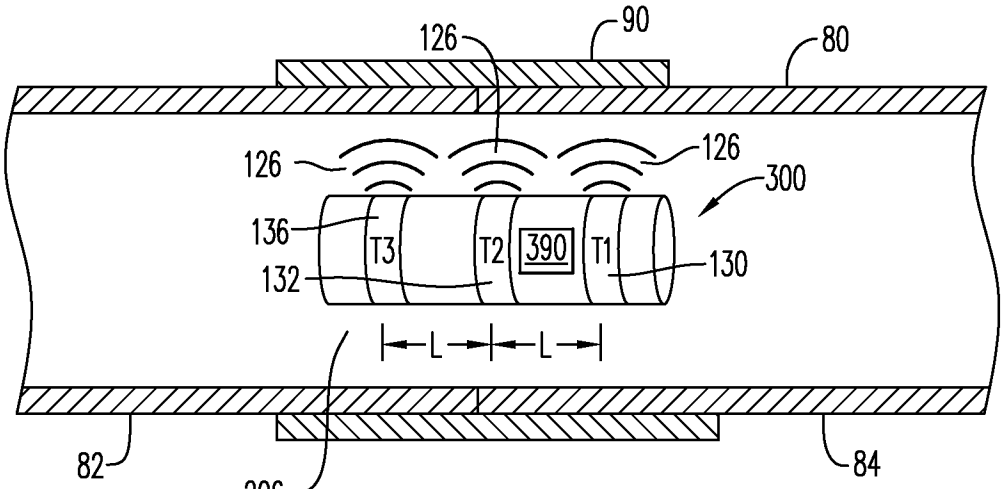
FIG. 5 is a cross-sectional plan view of a three ultrasonic transceiver based navigation system of an embodiment.

FIG. 4 illustrates an untethered drone 300 that includes the first ultrasonic transceiver 130 and the second ultrasonic transceiver 132. Each ultrasonic transceiver 130, 132 is capable of detecting alterations in the medium through which the untethered drone 300 is traversing by transmitting an ultrasound signal 126 and receiving a return ultrasound signal 128 (see FIG. 6). Although only the transmitted ultrasound signal 126 is shown in FIGS. 4 and 5, the ultrasonic transceivers utilized are both transmitting and receiving ultrasound signals 126, 128 in an effectively constant manner. Changes in the material and geometry of wellbore casing 80 and other material external to wellbore casing 80 will often result in a substantial change in the return ultrasound signal 128 received by receiving element 106 and conveyed to computer/processor 390. Such changes may involve the transition from a first casing portion 82 to a second casing portion 84, including a casing collar 90 that may be present at such a transition. More generally and, as will be presented hereinbelow, the changes in the material/geometry may be referred to as an anomalous point 206.

Figure 9:
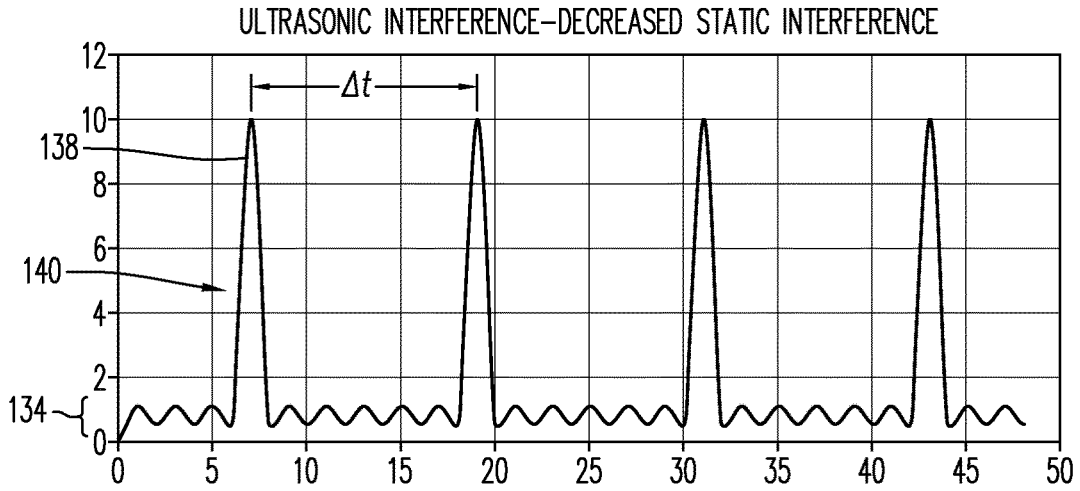
FIG. 9 is a graphical representation of a return electrical signal based on a return ultrasound signal received by the receiving element of an ultrasonic transceiver.

FIG. 9 presents an example of a return electrical signal 140 input to and/or output from computer/processor 390 based on the return ultrasound signal 126 received by the receiving element 106 of ultrasonic transceiver 100. The x-axis of FIG. 9 is time and the y-axis may be any one of a number of optional measurements utilized in ultrasound transducer technology. For the purposes of this disclosure, it may be assumed that the y-axis is some measure of signal strength of the return ultrasound signal 126 or some selected, i.e., filtered, portion thereof. That is, with reference also to FIGS. 3A and 3B, the transmitting element 104 of transducer 100 emits a transmitted ultrasound signal 126 into the material external to the untethered drone 300 and a portion of this transmitted ultrasound signal 126 is reflected by various portions of the material external to the untethered drone 300; the reflected ultrasound waves may be referred to as the return ultrasound signal 128. The return ultrasound signal 128 is received by the receiving element 106 and a signal is sent by receiving element 106 to computer/processor 390. The return electrical signal 140 is either the signal sent by the receiving element 106 to the computer/processor 390 or that signal modified by filters and/or software of the computer/processor 390. Either way, it is an electrical representation of the return ultrasound signal 128.

Interpretation of the return electrical signal 140 may be performed at least partially by inference, based on the known changes in the medium through which the ultrasound transceiver 100 is passing. For example, in the event that the return electrical signal 140 of FIG. 9 is received from a transceiver 100 passing through a wellbore 16 at a constant velocity and this velocity would have caused transceiver 100 to pass through about four casing collars 90 in the measured time period, i.e., y-axis, some inferences may be made. It may be inferred that the base return signal 134 represents the return ultrasound signal 128 when the transceiver 100 is passing through only the wellbore casing 80 that is not covered by a casing collar 90, i.e., the majority of the wellbore. Return signal 134 may also be considered to represent 'noise' or, essentially, no signal of significance. It may also be inferred that each modified return signal 138, equally spaced in time, represents the return ultrasound signal 128 when the transceiver 100 is passing through a portion of the wellbore casing 80 at the point where it is connected to the next wellbore casing 80 by a casing collar 90.

Figure 10:
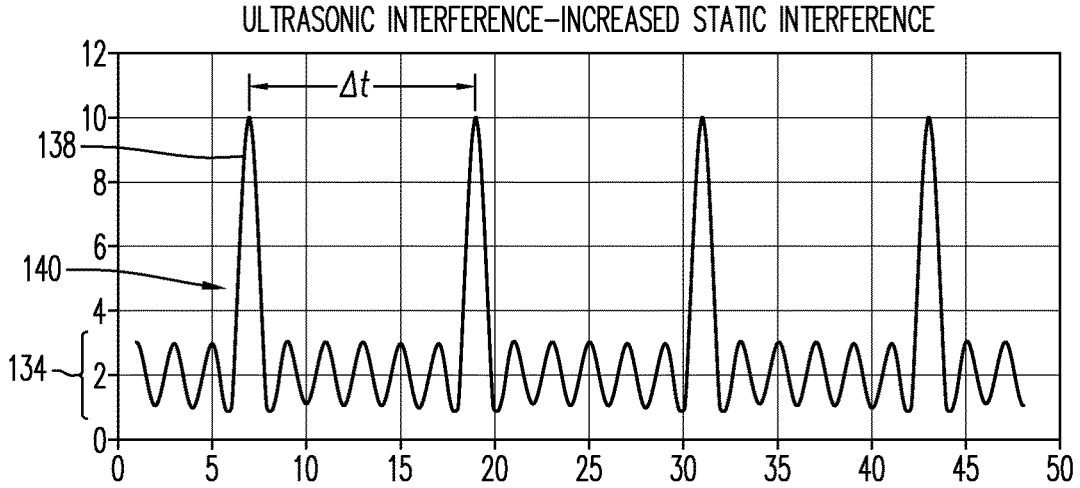
FIG. 10 is a graphical representation of a return electrical signal based on a return ultrasound signal received by the receiving element of an ultrasonic transceiver.
Figure 10A:
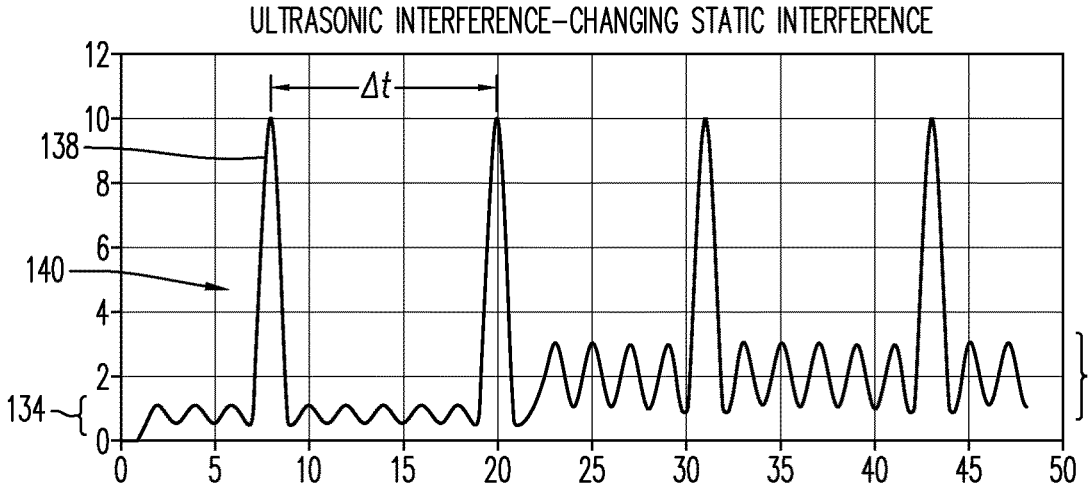
FIG. 10A is a graphical representation of a return electrical signal based on a return ultrasound signal received by the receiving element of an ultrasonic transceiver.

FIG. 10 and FIG. 10A are two additional examples of a return electrical signal 140 input to and/or output from computer/processor 390 based on the return ultrasound signal 126 received by the receiving element 106 of ultrasonic transceiver 100. FIG. 10 illustrates an example where the base return signal 134, i.e., potential noise, is substantially greater than in FIG. 9, although the modified return signal 138 remains easily identifiable. FIG. 10A illustrates an example where the base return signal 134 is variable in strength.

In an embodiment, a navigation system 10 may include one or more ultrasonic transceivers 100 or T1, T2, T3, etc., connected to a computer/processor 390. The navigation system 10 may be provided on or installed in the associated structures of the untethered drone 300. The worker skilled in the art knows that integration of the navigation system 10 with the untethered drone 300 is a straightforward matter, especially in light of the disclosure provided herein. Similarly, the onboard computer/processor 390 may be a part of the navigation system 10 or the navigation system 10 may supply information or electrical signals to the onboard computer/processor 390. The elements of the navigation system 10 may be contained in the body portion 310, head portion 320 or tail portion 330 of the untethered drone 300. Alternatively, the different elements of the navigation system 10 may be spread across the various elements of the untethered drone 300 with electrical connections therebetween, as appropriate. To the extent that placement of portions of the navigation system 10 are material to the functioning thereof, such placement is described in further detail hereinbelow.

While the ultrasound embodiment of navigation system 10 presented herein may be used to detect the differences in the metal thickness between a typical pipe section 80 and a pipe section encompassed by a collar 90, it uses a different physical principle than traditional/standard casing collar locator ("CCL") systems. That is, the ultrasound transceiver 100 may be substantially different in a number of respects from a known CCL. Further, ultrasound transceivers 100 are not necessarily limited to detecting casing collars 90 along the length of wellbore 16. Other anomalous points may result in a modified return signal 138 to the ultrasound transceiver 100 sufficient to be noticed above the base return signal 134. Such anomalous points may be inside the wellbore 16, associated with the pipe section or other structural components of the wellbore 16. In addition, anomalous points external to the wellbore 16, i.e., native to the geological formation through which the wellbore 16 passes, may also return a sufficient modified return signal 138. As will be further described hereinbelow, the precise nature of an anomaly is not of great importance to embodiments described in this application. Rather, the existence and repeatability of a modified return signal 138, especially the latter, are of far greater utility to the described embodiments.

In the embodiment shown in FIG. 4, the navigation system 10 includes two ultrasonic transceivers 100, identified as T1 and T2. Besides acting as a verification of T1 passing a change in physical properties, i.e., an anomaly, second transceiver T2 enables an important function of navigation system 10. Since T2 is axially displaced from T1 along the long axis of untethered drone 300, T2 passes through an anomaly in wellbore 16 at a different time than T1 as untethered drone 300 traverses the wellbore 16. Put another way, assuming the existence of an anomalous point 206 along the wellbore, T1 and T2 pass the anomalous point 206 in wellbore 16 at slightly different times. In the event that T1 and T2 both register a sufficiently strong and identical, i.e., repeatable, modified return signal 138 as a result of an anomaly at the anomalous point 206, it is possible to determine the time difference between T1 registering the anomaly at the anomalous point 206 and T2 registering the same anomaly. The distance L between T1 and T2 being a known, a sufficiently precise measurement of time between T1 and second T2 passing a particular anomaly provides a measure of the velocity of the navigation system 10, i.e., velocity equals change in position divided by change in time. Utilizing the typically safe presumption that an anomaly is stationary, the velocity of the untethered drone 300 through the wellbore 16 is available every time the untethered drone 300 passes an anomaly that returns a sufficient change in amplitude for each of T1 and T2.

As mentioned previously, the potential exists for locating ultrasonic transceiver T1 and ultrasonic transceiver T2 in different portions of untethered drone 300 and connecting them electrically to computer/processor 390. As such, it is possible to increase the axial distance L between T1 and T2 almost to the limit of the total length of untethered drone 300. Placing T1 and T2 further away from one another achieves a more precise measure of velocity and retains precision more effectively as higher drone velocities are encountered, especially where sample rate for T1 and T2 reach an upper limit.

Further to the foregoing, the return electrical signal 140 is based on the return ultrasound signal 126 received by the receiving element 106 of ultrasonic transceiver 100. A separate return electrical signal 140 exists for each of T1 and T2. These two return electrical signals 140 may be compared by onboard computer 390 to identify sufficiently identical modified return signals 138. Potentially, signal processing, amplifying and filtering circuitry may be integrated with the onboard computer/processor 390 to optimize this comparison. In an embodiment, the critical data point achieved by the comparison of the two return electrical signals 140 from T1 and T2 is the time between one transceiver identifying a particular anomaly and the other transceiver identifying the same anomaly.

In another embodiment, illustrated in FIG. 4, a third ultrasonic transceiver 136 is added to the untethered drone 300 navigation system 10. This third transceiver 136 is designated T3. The onboard computer/processor 390 may now be provided with three distinct return electrical signals 140 for detecting anomalous points. The fact that the distance L between adjacent transceivers, i.e., T1 to T2 and T2 to T3, is reduced is not of particular importance since the larger distance between T1 and T3 may also still be utilized by the computer/processor. Thus, although adjacent transceivers 200 may certainly be utilized by computer/processor 390 in spite of the shortened axial displacement between them, the primary usefulness of the third or higher order transceiver is further confirmation that a particular modified return signal 138 for an anomaly is truly identical and repeatable between transceivers 200.

Figure 6:
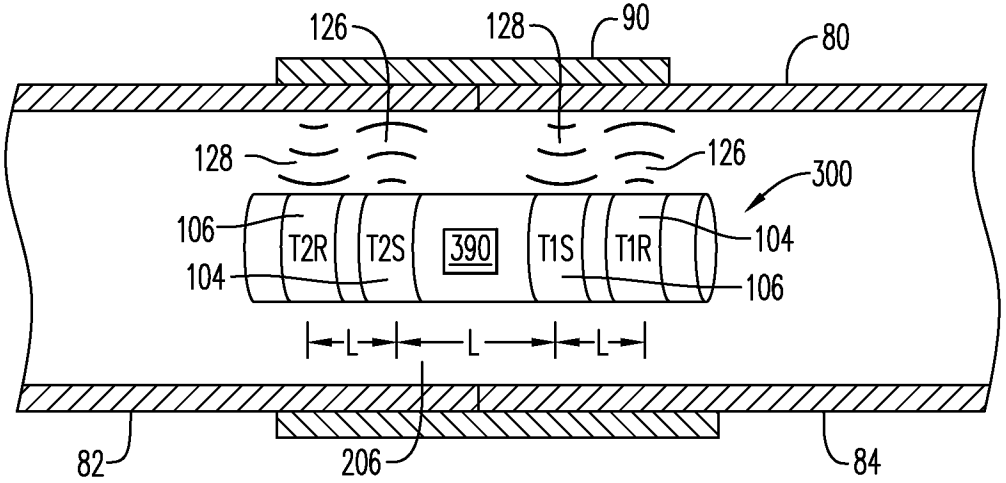
FIG. 6 is a cross-sectional plan view of a two ultrasonic transmitter and two ultrasonic receiver based navigation system of an embodiment.

A further embodiment is illustrated in FIG. 6 and shows a system where the ultrasonic transducers 200 have the transmitters T1S, T2S separate from the receivers T1R, T2R. Other than some slight modifications to account for the offsets between the transmitters and receivers, the embodiment of FIG. 6 operates in the same way as integrated embodiments.

Figure 7:
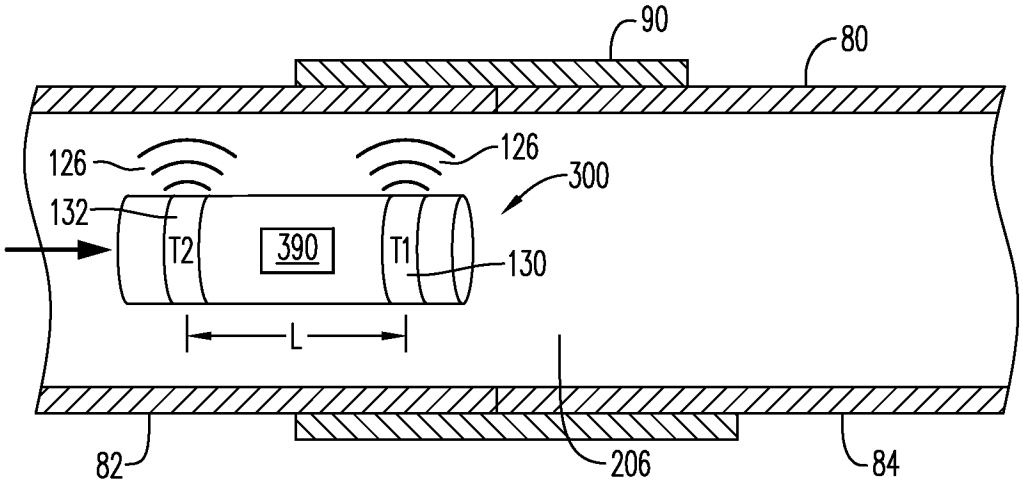
FIG. 7 is a cross-sectional plan view of the FIG. 4 embodiment with transceiver T1 adjacent an anomalous point 206 in wellbore 16.
Figure 8:
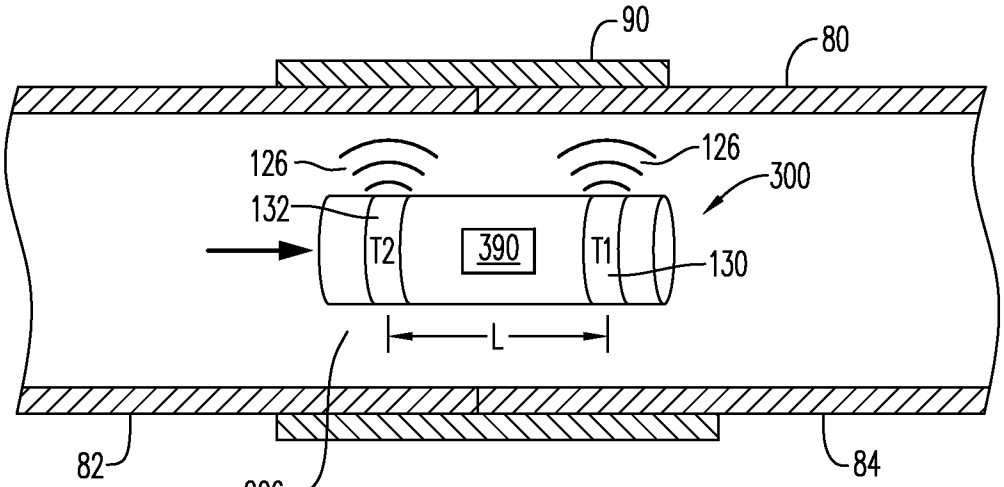
FIG. 8 is a cross-sectional plan view of the FIG. 4 embodiment with transceiver T2 adjacent an anomalous point 206 in wellbore 16.

FIG. 7 and FIG. 8 illustrate the movement of an untethered drone 300 having a navigation system 10 that includes ultrasonic transceivers T1 and T2 in a wellbore 16. The anomalous point 206 may be considered the location at which the return electrical signals 140 of each of T1 and T2, as seen in FIGS. 9 and 10, register a sufficiently strong and identical modified return signal 138. The time it takes for untethered drone 300 to move from its location shown in FIG. 7 to its location shown in FIG. 8, measured by the computer/processor 390, may be converted into a velocity by dividing L by the measured time.

Figure 11:
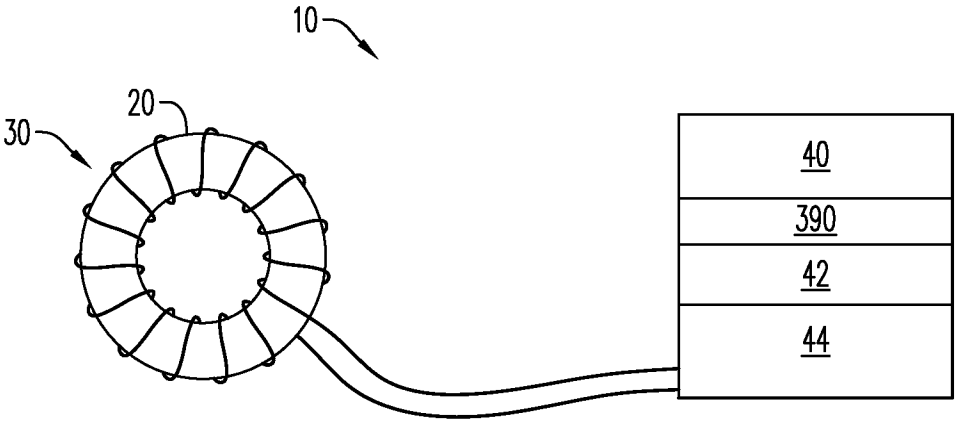
FIG. 11 is a plan view of a simplified version of a navigation system of an embodiment.

FIG. 11 illustrates another embodiment of the navigation system 10 that includes active oscillator circuit for detecting alterations in the medium through which the untethered drone 300 is traversing. The navigation system 10 may be provided on or installed in the associated structures of the untethered drone 300. The worker skilled in the art knows that integration of the navigation system 10 with the untethered drone 300 is a straightforward matter, especially in light of the disclosure provided herein. Similarly, the onboard computer/processor 390 may be a part of the navigation system 10 or the navigation system 10 may supply information or electrical signals to the onboard computer/processor 390. The elements of the navigation system 10 may be contained in the body portion 310, head portion 320 or tail portion 330 of the untethered drone 300, see FIG. 2. Alternatively, the different elements of the navigation system 10 may be spread across the various elements of the untethered drone 300 with electrical connections therebetween, as appropriate. To the extent that placement of portions of the navigation system 10 are material to the functioning thereof, such placement is described in further detail hereinbelow.

While the navigation system 10 described herein may be used to detect the differences in the metal thickness between a typical pipe section 80 and a pipe section encompassed by a collar 90, it uses a different physical principle than traditional/standard CCL systems. The navigation system 10 utilizes a signal generating and processing unit 40 attached to a wire coil 30. The wire coil 30 may be wrapped around a core 20. According to an aspect, the core 20 is made of a material that is highly permeable to magnetic fields, such high permeability materials including at least one of ferrite, laminated iron and iron powder. The magnetic field strength of the wire coil 30 is greatly increased with the use of the core 20 having high permeability. The core 20 may be of any shape, such as the toroidal shape shown in FIG. 11 and FIG. 12.

The navigation system 10 further includes a signal generating and processing unit 40. The processing unit may include an oscillator 44 and a capacitor 42. An oscillating signal is generated by the oscillator 44 and sent to the wire coil 30. With the wire coil 30 acting as an inductor, a magnetic field is established around the wire coil 30 when charge flows through the coil 30. Insertion of a capacitor 42 in the circuit results in constant transfer of electrons between the coil/inductor 30 and capacitor 42, i.e., in a sinusoidal flow of electricity between the coil 30 and the capacitor 42. The frequency of this sinusoidal flow will depend upon the capacitance value of capacitor 42 and the magnetic field generated around coil 30, i.e., the inductance value of coil 30. The peak strength of the sinusoidal magnetic field around coil 30 will depend on the materials immediately external to coil 30. With the capacitance of capacitor 42 being constant and the peak strength of the magnetic field around coil 30 being constant, the circuit will resonate at a particular frequency. That is, current in the circuit will flow in a sinusoidal manner having a frequency, referred to as a resonant frequency, and a constant peak current.

When the signal processing unit 40 and the coil 30 are moved through a material and/or moved past structures that do not alter the magnetic field around coil 30, current will flow through the circuit with a resonant frequency and an unchanged amplitude. For example, a coil passing through a pipe filled with an essentially homogenous fluid, where the pipe is surrounded by essentially homogenous material (soil, rock, etc.) and further wherein the dimensions of the pipe are constant along its length, will have constant inductance because the magnetic permeability of materials around the coil will be constant. However, when coil 30 is moved through a material and/or past structures that do impact the magnetic field around coil 30, i.e., past or through an object having different magnetic permeability, the inductance value of coil 30 is altered and, thus, the resonant frequency is changed.

The above description describes a passive circuit, i.e., a circuit that is charged with electrons and current then flows between the capacitor 42 and coil (inductor) 30 with a particular frequency. In an active circuit, electron flow may be imposed on the same capacitor/inductor circuit by an oscillator 44. The frequency of the circuit will not be affected by the capacitance and inductance values present in the circuit, since they are driven by the oscillator 44. In an active circuit, what will instead be altered by a change in the inductance value of the inductor is the maximum peak current. That is, when the inductance value is the only change in the circuit and the frequency of the sinusoidal signal is kept constant, it is the amplitude of the signal that will be increased or decreased.

Figure 12:
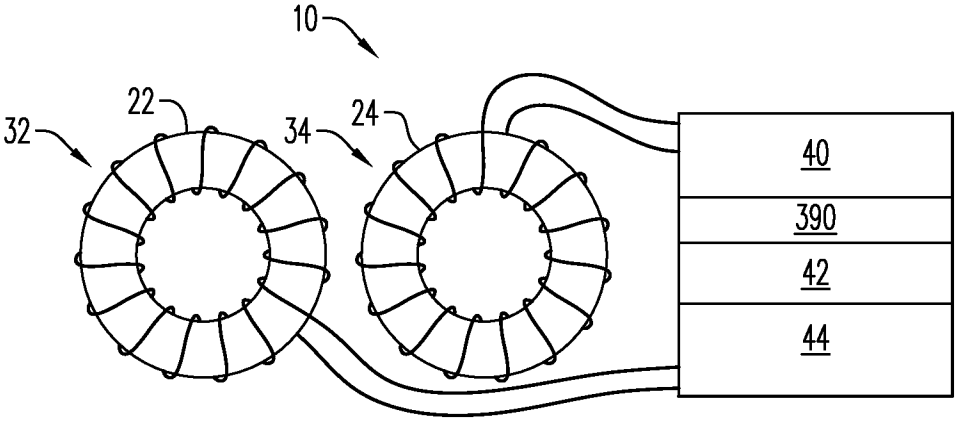
FIG. 12 is a plan view of a navigation system of an embodiment.

In an embodiment of the navigation system 10 described herein, two coils are used. As seen in FIG. 12, the signal generating and processing unit 40 is attached to both ends of a first coil 32 wrapped around a first core 22 of high magnetic permeability material as well as both ends of a second coil 34 wrapped around a second core 24 or high magnetic permeability material. As discussed previously, although the cores 22, 24 and coils 32, 34 are presented in FIG. 12 as toroidal in shape, although other shapes are possible. An exemplary embodiment of the present disclosure has the first coil 32 and the second coil 34 configured coplanar to one another. Since a toroidal coil defines a plane, the magnetic field established by such a coil possesses a structure related to this plane. Changes in magnetic permeability occurring coplanar to the plane of the toroidal coil will have greater effect on the coil's inductance than changes that are not coplanar. Changes in magnetic permeability in a plane perpendicular to the plane of the coil may have little to no impact on the coil's inductance value. As will be discussed hereinbelow, embodiments of the present disclosure may register the same anomaly, i.e., change in magnetic permeability, once for each coil. In this configuration, having the coils 32, 34 disposed on the same plane may achieve this result.

Besides being coplanar, embodiments of the present disclosure may require the first coil 32 and second coil 34 to be displaced axially with respect to one another. The axis in question is the long axis of the drone which should, typically, be substantially identical to the axes of the wellbore 16 and the wellbore casing 80. The utility of the axial displacement of the coils 32, 34 will be apparent from the description hereinbelow.

The frequency and amplitude output by the oscillating circuitry can be adjusted to the applicable geometry of the wellbore casing pipes 80, which come in a number of diameters, e.g., 4.5", 5.5" or 6" outside diameter. For purposes to be discussed hereinbelow, the frequency output by the oscillating circuitry may also be adjusted based on the velocity at which the untethered drone 300 containing the wellbore navigation system 10 is travelling through the wellbore 16. Wellbore casing pipes are typically joined together by a casing collar 90.

For a given frequency and power level output by the oscillator 44 and a known, constant capacitance for capacitor 42, the variable in the electrical circuit including the first coil 32 is the inductance value of the first coil 32. Since this inductance value is, in turn, dependent on the magnetic permeability of the materials surrounding first coil 32, changes in the magnetic permeability of the materials surrounding first coil 32 may cause a change in the flow of electricity in the electrical circuit of which the first coil 32 is a part. Since, as stated, the frequency is determined by the oscillator 44, the change in the oscillating current takes the form of a change in amplitude, i.e., the peak current through the circuit will vary. Therefore, a change in the magnetic permeability of the materials surrounding the first coil 32 will result in the inductance value of first coil 32 changing; this changed inductance value results in a change in the peak current of the circuit. The same is true for the second coil 34.

Figure 13:
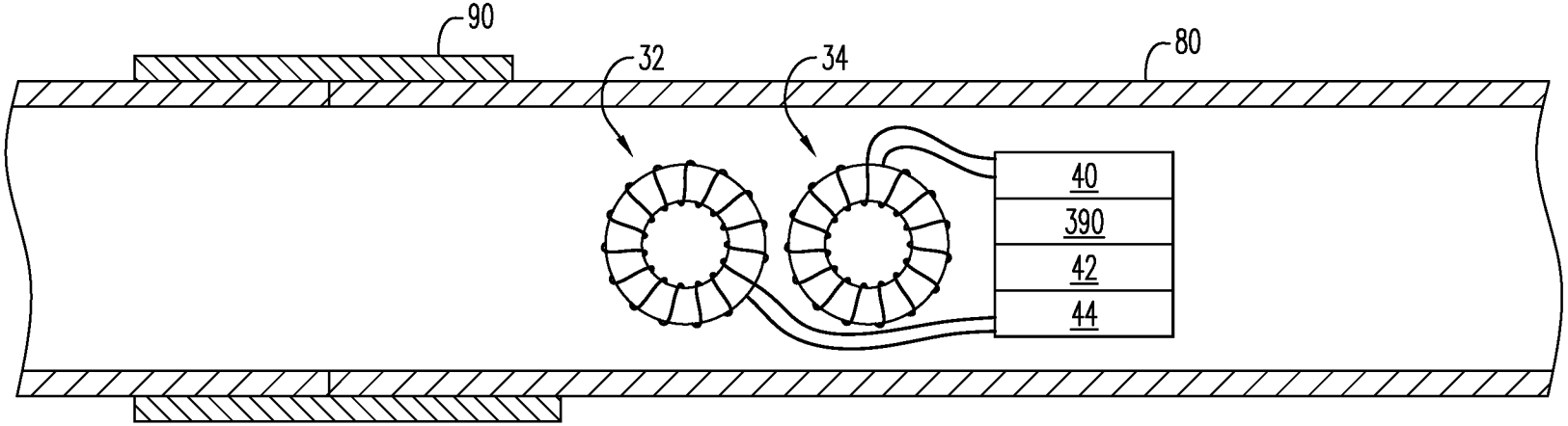
FIG. 13 is a cross-sectional plan view of the navigation system of FIG. 4 disposed in a section of wellbore casing.
Figure 14:
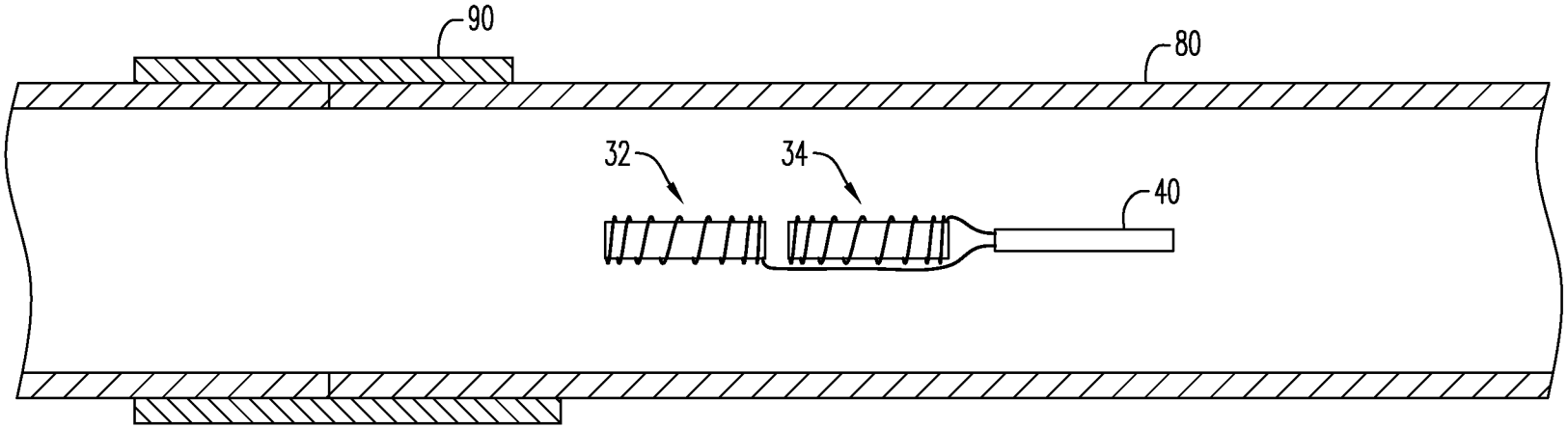
FIG. 14 is a side view of FIG. 13.

FIG. 13 shows wellbore navigation system 10 inside wellbore casing 80. FIG. 14 shows a side view of the same arrangement as FIG. 13. For purposes of clarity, the various structures of untethered drone 300 are not shown in any of the figures showing navigation system 10 inside wellbore casing 80; again, incorporation of navigation system 10 is well understood by one of ordinary skill in the art.

Figure 14A:
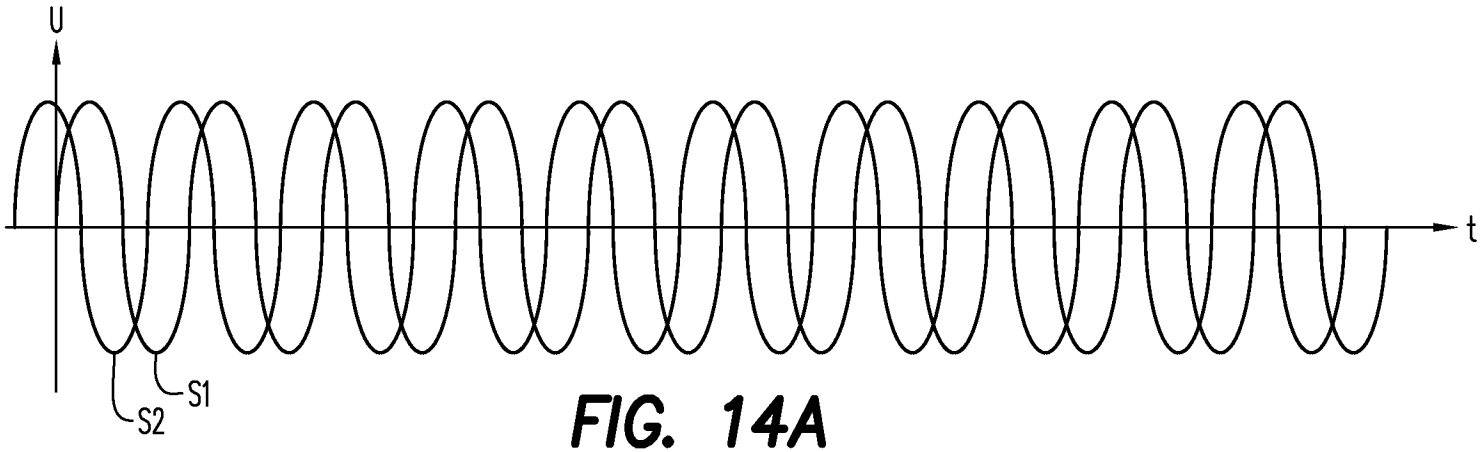
FIG. 14A is a graphical representation of electrical current S1 through coil 32 and electrical current S2 through coil 32 in the navigation system of FIG. 14.

FIG. 14A is a graphical representation of the signal S1, representing the electrical current in first coil 32, and signal S2 represents the electrical current in second coil 34. In at least one embodiment, the phase shift between S1 and S2 may be useful in visualizing S1 and S2 on the same graph. Whether or not navigation system 10 is moving relative to wellbore casing 80 is not material to either S1 or S2. Rather, the only variable being the magnetic permeability of the materials surrounding coils 32, 34, FIG. 14A merely tells us that the inductance value for first coil 32 is equal to the inductance value of second coil 34. From this it can be inferred that the materials surrounding the two coils are the same.

Figure 15:
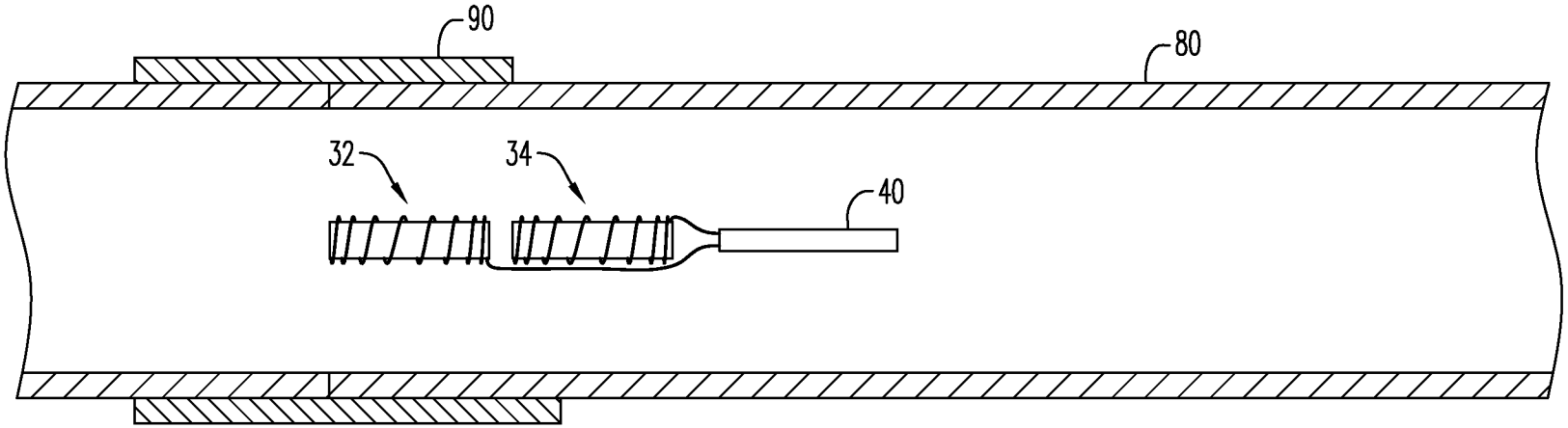
FIG. 15 is a side view of FIG. 13 wherein the navigation system has moved to the left.
Figure 15A:
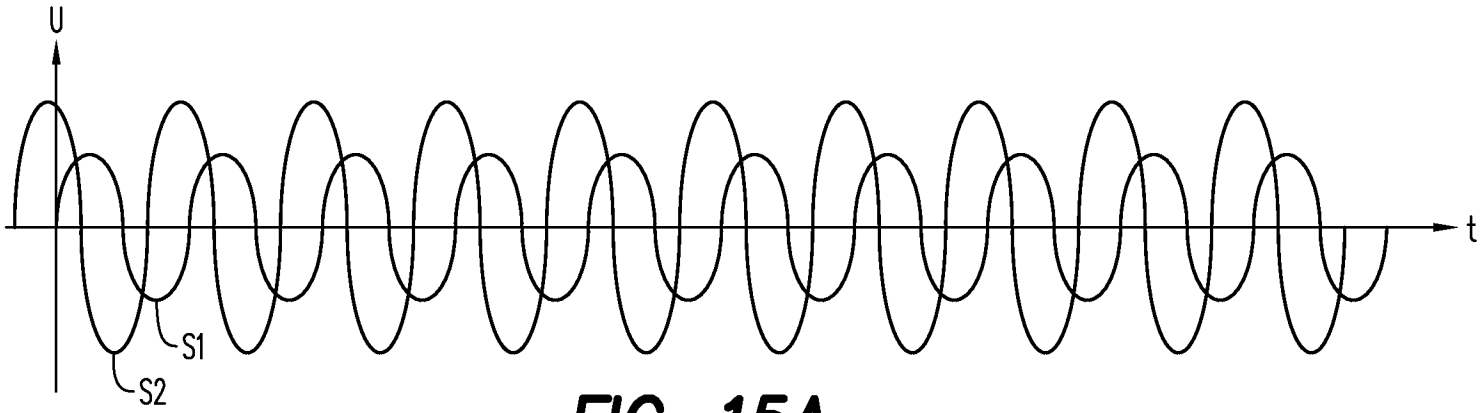
FIG. 15A is a graphical representation of electrical current S1 through coil 32 and electrical current S2 through coil 32 in the navigation system of FIG. 15.

With reference to FIG. 15, it can be seen that the wellbore navigation system 10 has moved relative to its position in FIGS. 13 and 14. Signal S1 in FIG. 15A has a substantially reduced amplitude when compared with signal S1 in FIG. 14A; this tells us that the inductance value for first coil 32 has changed substantially as a result of the movement between FIG. 14 and FIG. 15. Signal S2 in FIG. 15A is not substantially different from signal S2 in FIG. 14A. We can infer from these two facts that the materials surrounding first coil 32 have changed substantially as a result of its movement from its position in FIG. 14 to its position in FIG. 15. We can also infer that the materials surrounding second coil 34 have not changed as a result of this same movement.

Figure 16:
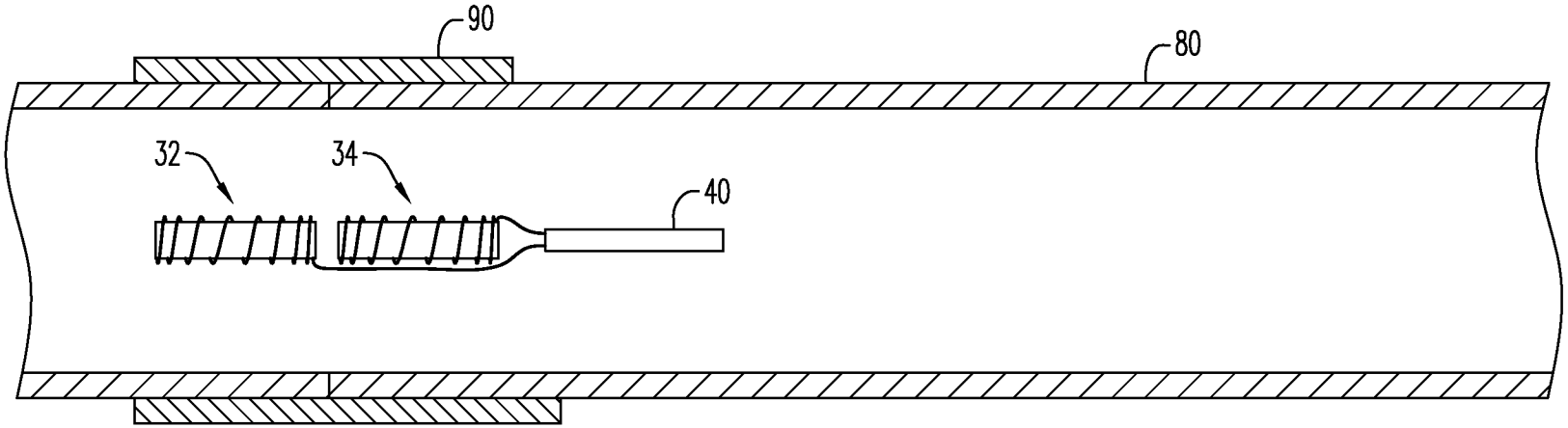
FIG. 16 is a side view of FIG. 13 wherein the navigation system has moved to the left.
Figure 16A:
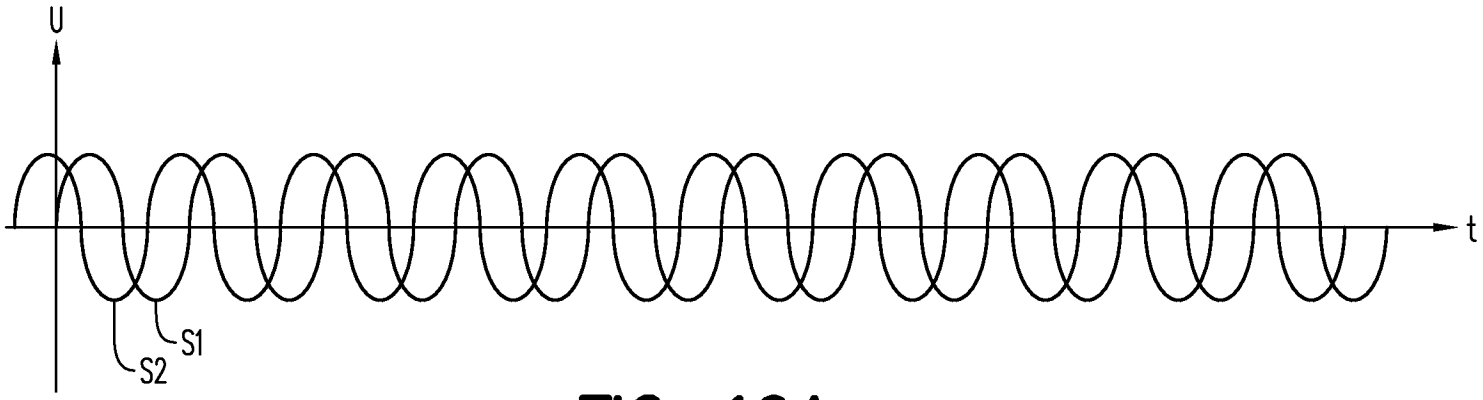
FIG. 16A is a graphical representation of electrical current S1 through coil 32 and electrical current S2 through coil 32 in the navigation system of FIG. 16.

With reference to FIG. 16, it can be seen that wellbore navigation system 10 has continued its movement relative to its positions in FIGS. 14 and 15. Signal S1 in FIG. 16A has a substantially reduced amplitude when compared with signal S1 in FIG. 14A but essentially the same amplitude when compared to signal S1 in FIG. 15A; this tells us that the inductance value for first coil 32 has changed substantially as a result of the movement between FIG. 14 and FIG. 15 but has not changed substantially as a result of the movement between FIG. 15 and FIG. 16. We can infer from these two facts that the materials surrounding first coil 32 changed substantially as a result of its movement from its position in FIG. 14 to its position in FIG. 15 but have not changed as a result of its movement from its position in FIG. 15 to its position in FIG. 16. Signal S2 in FIG. 16A is substantially different from signal S2 in FIG. 14A and FIG. 15A. We can infer from this that the materials surrounding second coil 34 did not change as a result of movement of the second coil from its position in FIG. 14 to FIG. 15 but changed substantially as a result of the movement of second coil 34 from its position in FIG. 15 to its position in FIG. 16.

If we now think of FIGS. 14, 15 and 16 as three snapshots of navigation system 10 as it moves from right to left inside wellbore casing 80, we can extend our inferences based on changing signals S1 and S2. We can infer, first, that when the snapshot depicted in FIG. 14 was taken, first coil 32 and second coil 34 were both located in a section of casing 80 of essentially identical physical properties. Next, we can infer from the snapshot depicted in FIG. 15 that, based on changes to signal S1, navigation system 10 moved and that first coil 32 has entered a section of casing 80 having substantially different physical properties than those found in the previous location, i.e., that shown in FIG. 14. Based on the lack of changes to signal S2, we can infer that second coil 34 has not yet entered the section of casing 80 having substantially different physical properties. We can infer from the snapshot depicted in FIG. 16 and signals in FIG. 16A that first coil 32 remains in a section having substantially different physical properties than those found at the location shown in FIG. 14, i.e., the physical properties around first coil 32 in FIG. 16 are essentially the same as those around the same coil in FIG. 15. Regarding second coil 34, however, based on changes to signal S2 from FIGS. 14A and 15A to FIG. 16A, second coil 34 has entered a section of casing 80 having substantially different physical properties than those found in the previous snapshot locations, i.e., FIGS. 14 and 15. Further, FIG. 16A tells us that first coil 32 and second coil 34 are located in a section of casing 80 of essentially identical physical properties. Comparing FIG. 14A and FIG. 16A, we can see that at least the portion of untethered drone 300 that encompasses both first coil 32 and second coil 34 has passed from one section of casing 80 to a different section of casing 80 having different physical properties.

Figure 17:
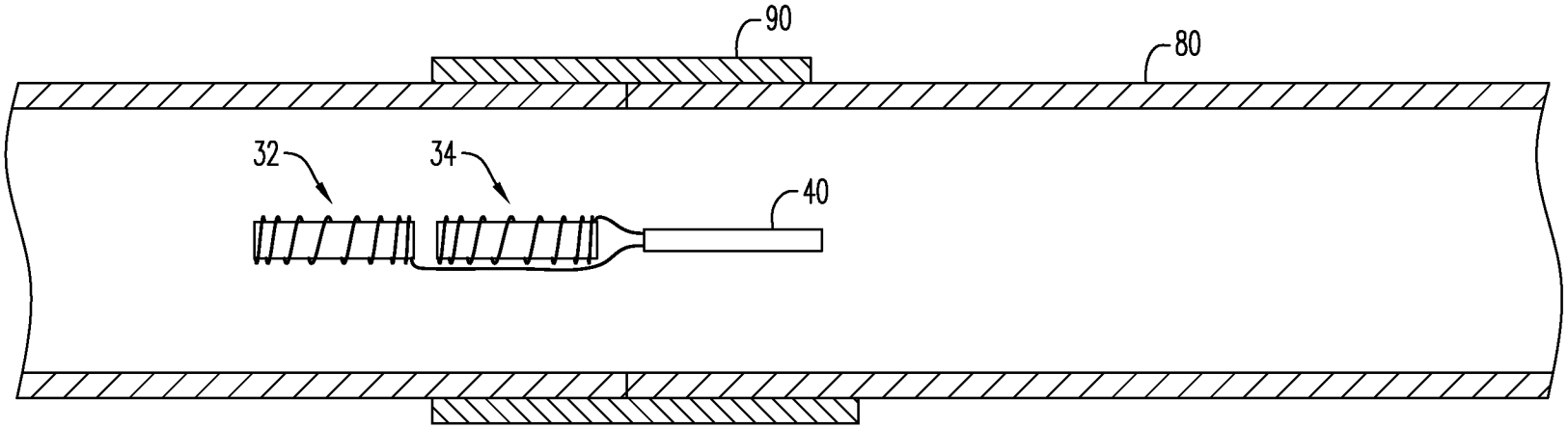
FIG. 17 is a side view of FIG. 13 wherein the navigation system has moved to the left.
Figure 17A:
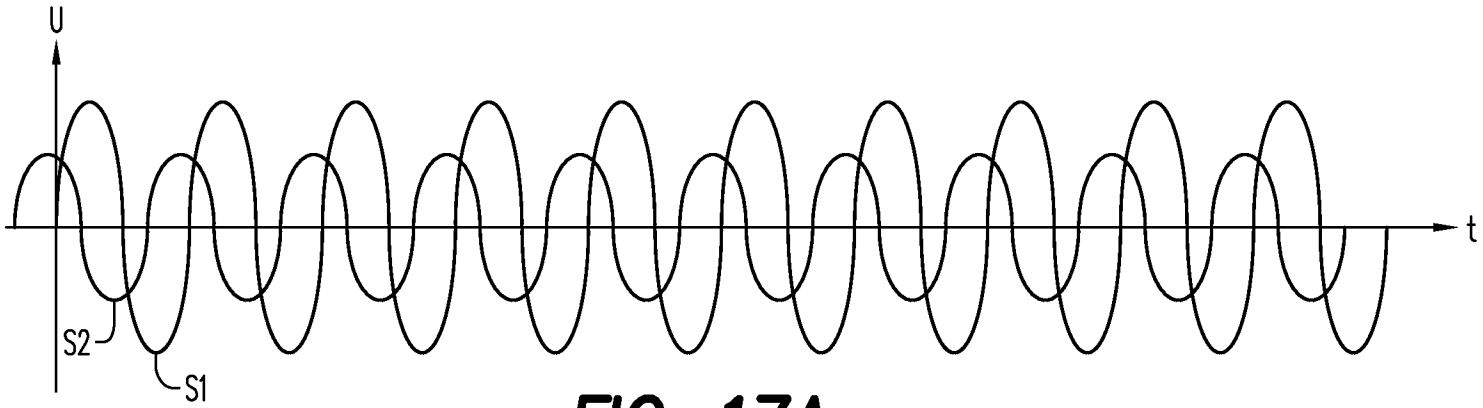
FIG. 17A is a graphical representation of electrical current S1 through coil 32 and electrical current S2 through coil 32 in the navigation system of FIG. 17.
Figure 18:
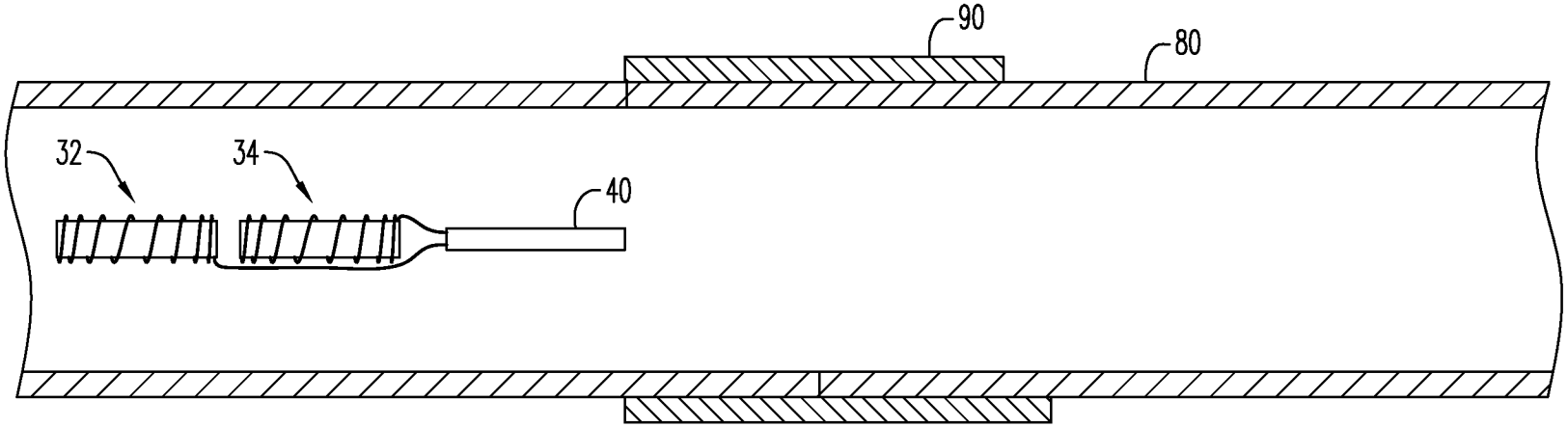
FIG. 18 is a side view of FIG. 13 wherein the navigation system has moved to the left.
Figure 18A:
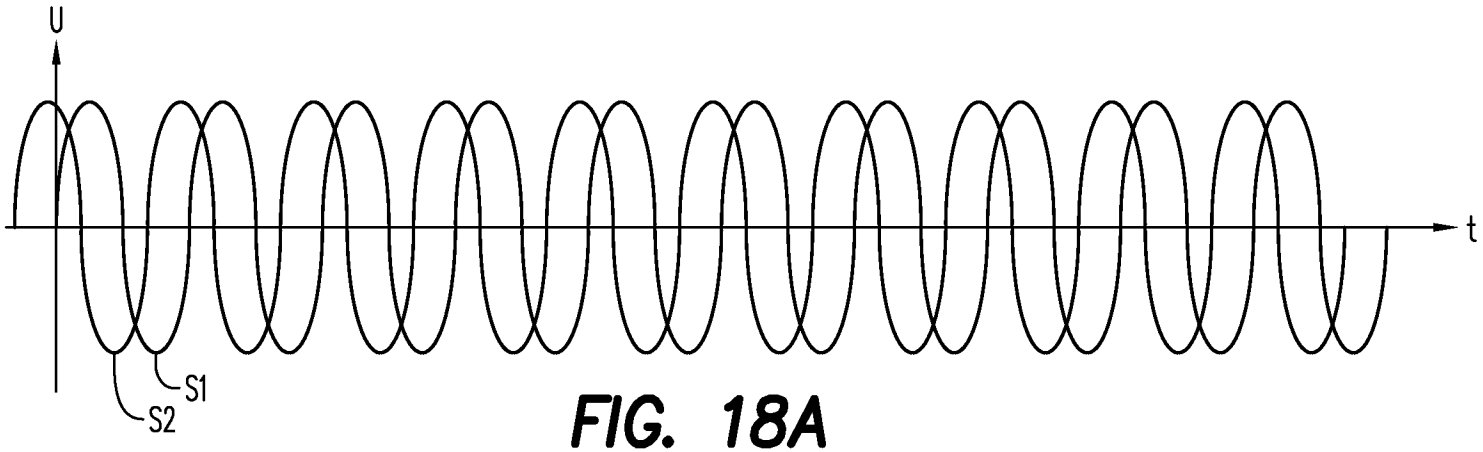
FIG. 18A is a graphical representation of electrical current S1 through coil 32 and electrical current S2 through coil 32 in the navigation system of FIG. 18.

Two additional snapshots of navigation system 10 and its position within wellbore casing 80 are provided in FIGS. 17 and 18. Further, current flow within coils 32 and 34 is provided for each position in FIGS. 17A and 18A. What we are able to infer from changes in S1 and S2 in FIGS. 17A and 18A is simply the reverse of what has been described above regarding FIGS. 15A and 16A. That is, the substantial change to signal S1 and absence of change to signal S2 in FIG. 17A compared to FIG. 16A show that first coil 32 has exited the section of casing 80 having different physical properties but that second coil 34 remains in that section when snapshot FIG. 17 is taken. The absence of change to signal S1 and substantial change to signal S2 in FIG. 18A compared to FIG. 17A show that both first coil 32 and second coil 34 have exited the section of casing 80 having different physical properties when snapshot FIG. 18 is taken. Comparison of FIG. 18A to FIG. 14A may be used to infer that the physical properties surrounding the navigation system 10 when snapshot FIG. 18 is taken are similar to the physical properties surrounding the navigation system 10 when snapshot FIG. 14 is taken.

Embodiments of the present disclosure presents an active oscillating circuit that is able to detect changes in physical properties around an untethered drone 300 as the drone passes through a wellbore 16. The detection is possible at both high and low velocities of the untethered drone 300 through the wellbore 16, while it has been noted that relatively high velocities of the drone movement (e.g., in the range of 5 m/s) result in more accurate readings. Further, passing a drone containing navigation system 10 along a wellbore while recording changes in signals S1 and S2, e.g., with onboard computer 390, will result in a map of changes in physical properties along the length of wellbore 16. This map will enable drones 300 containing a navigation system 10 programmed with the map to navigate the wellbore 16, i.e., know at all times the position of the drone within the wellbore 16.

Besides acting as a verification of first coil 32 passing a change in physical properties, second coil 34 enables an important function of navigation system 10. As we have seen, second coil 34 being displaced axially from first coil 32 along the long axis of untethered drone 300 results in first coil 32 and second coil 34 passing through an area of changed physical properties at different times as untethered drone 300 traverses the wellbore 16. Given a sufficient frequency for signals S1 and S2, as well as sufficiently high sample rate, it is possible to determine the time difference between first coil 32 encountering a particular anomaly, i.e., change in physical properties surrounding the coil, and second coil 34 encountering the same anomaly. The distance between first coil 32 and second coil 34 being a known, a sufficiently precise measurement of time between first 32 and second 34 coils passing a particular anomaly provides a measure of the velocity of the navigation system 10, i.e., velocity equals change in position divided by change in time. Added to the typically safe presumption that the anomaly is stationary, the velocity of the untethered drone 300 through the wellbore 16 is available every time the drone passes an anomaly that returns a sufficient change in amplitude for each of S1 and S2.

As mentioned previously, the potential exists for locating first coil 32 and second coil 34 in different portions of untethered drone 300 and connecting them electrically to signal generating and processing unit 40. As such, it is possible to increase the axial distance between first coil 32 and second coil 34 almost to the limit of the total length of untethered drone 300. Placing first 32 and second 34 coils further away from one another achieves a more precise measure of velocity and retains precision as higher drone velocities are encountered, especially where frequency and sample rate for S1 and S2 reach an upper limit.

An important advantage of the present system is that sensitivity of the detector is greatly increased. Rather than simply being able to detect the presence of a relatively bulky coupling collar 90, the navigation system 10 of the present disclosure has the ability to utilize the presence of many smaller anomalous points found along the length of a typical wellbore 16. While navigation system 10 may register both entry into and exit from each coupling collar 90 along the wellbore 16 and its casing 80, smaller anomalous points will also return sufficient amplitude changes in the current through first coil 32 to register as an anomaly. Importantly, second coil 34 may verify the presence of an anomaly. If, during a window of time related to the velocity of the untethered drone 300 through the wellbore 16, a similar change in amplitude of the current through second coil 34 does not occur, then first coil 32 amplitude change can be ignored.

Further to the foregoing, S1 from fist coil 32 and S2 from second coil 34 may be compared by onboard computer 390 using a signal processor and signal filtering circuitry that removes similarities between the two signals and emphasizes differences. An electronic amplifier and filter may be integrated with the onboard computer/processor 390. The amplifier reinforces the raw signal received from the coils while the filter removes noise from the amplified signals developed from the alterations in the resonant frequencies.

Figure 19:
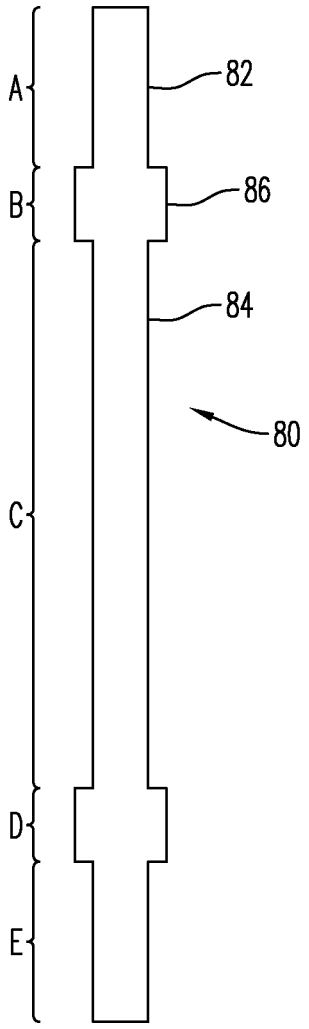
FIG. 19 is a plan view showing several sections of a wellbore casing.
Figure 19A:
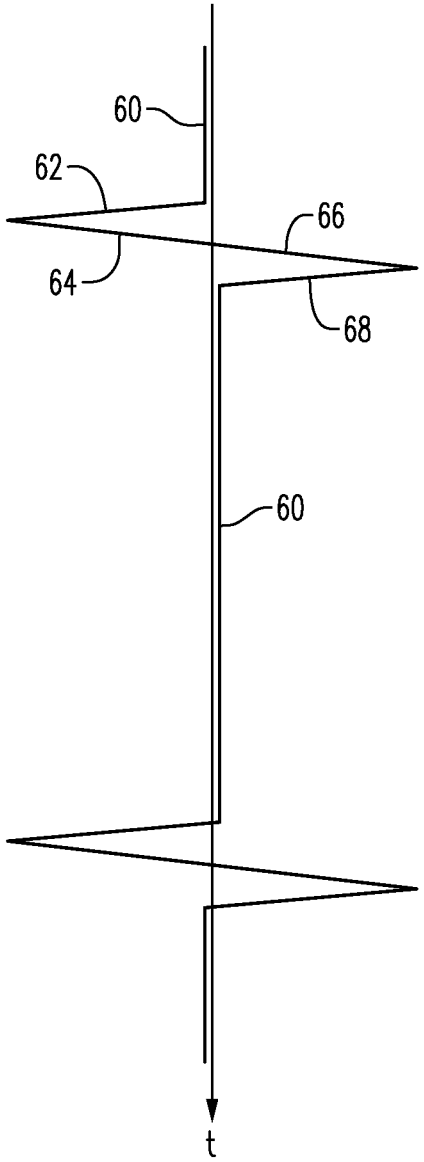
FIG. 19A is a graphical representation of a filtered electrical signal derived from electrical signals S1 and S2 when passing through wellbore casing shown in FIG. 19.

FIG. 19 illustrates a length of wellbore casing 80 wherein an anomaly 86 exists. Prior to anomaly 86 is shown as a first casing portion 82, and subsequent to anomaly 86 is shown as a second casing portion 84. FIG. 19A is a graphical representation of a processed signal that has been filtered and processed to emphasize differences between S1 from first coil 32 and S2 from second coil 34. As both coils 32, 34 traverse section A of the casing 80 the lack of difference between S1 and S2 is seen as the flat line 60. As first coil 32 enters section B, i.e., area of changed physical properties referred to as anomaly 86, the changing amplitude of signal S1 and unchanging amplitude of signal S2 result in signal 62. Once second coil 34 reaches section B, i.e., anomaly 86, signal S2 also begins changing and, as a result, the difference between S1 and S2 starts decreasing because signal S2 'follows' signal S1 once second coil 34 encounters the same anomaly 86. This reduction in difference between S1 and S2 results in signal 64. The signal shown in FIG. 19A passes through zero between signals 64 and 66 when both first coil 32 and second coil 34 are equally affected by anomaly 86. As first coil 32 exits section B, the amplitude difference between the amplitude of S1 and S2 results in signal 66. Exit of second coil 34 from section B results in signal 68. Once both first coil 32 and second coil 34 are past anomaly 86 and again in a more homogenous second casing portion 84, the difference between S1 and S2 should be minimal, as seen in a return to signal 60.

Application of a filter to a processed signal like the one shown in FIG. 19A will result in a number of significant anomalous points along a wellbore 16. Examples of such anomalous points include inconsistencies/heterogeneities in wellbore casing 80. Such heterogeneities will typically be a function of the quality, age and prior use of various sections of casing 80. For example, heterogeneities in casing 80 may be introduced by damage, wear-and-tear, manufacturing defects and designed structures (e.g., coupling collars 90, valves, etc.). Designed structures may even be included as part of the casing for purposes of assisting navigation system 10.

As a result of its increased sensitivity and related self-verifying feature, anomalous points are not limited to heterogeneities associated with the wellbore casing 80. Rather, navigation system 10 may be tuned to have the magnetic fields of its inductors, i.e., first coil 32 and second coil 34, extend beyond the outside diameter of wellbore casing 80. Since air, water, soil, clay, rock, etc, have varying magnetic permeabilities, such wellbore features as entry into the ground and passage between various geological layers are detected as changes in magnetic permeability of the materials surrounding coils 32 and 34. Such transitions as entry of the casing from air into ground and entrance/exit from an aquifer typically present a particularly strong signal. Further, since geological layers typically contain heterogenous sections and/or components such as rocks containing various ores, such heterogeneities close enough to wellbore casing 80 may also be detected by navigation system 10.

The frequency of the active field generated by the coils 32, 34 impacts the resolution measurements of navigation system 10. For a higher velocity of untethered drone 300, a higher signal frequency will result in more accurate measurement of signal changes. However, in the event that higher frequencies may result in shortened battery life for the drone electronics, it may be advisable to have lower frequencies when higher frequencies are not required. Navigation system 10 may dynamically vary signal frequency depending on measured speed changes, utilizing lower frequencies at lower untethered drone 300 velocities to conserve power.

Since toroidal coils 32, 34 occupy a plane, anomalous points are more strongly detected based on how much of the anomaly occupies a plane that is coplanar to coils 32, 34. In an embodiment, two pairs of coils are used; the second pair of coils are rotated 90° about the long axis of the drone. This relationship between the two pairs of coils will provide at least some anomaly detection around the entire circumference of the wellbore casing 80. This multiplication of coils may also be utilized as further verification of anomalous points and add to increases of signal-to-noise ratios.

Figure 20:
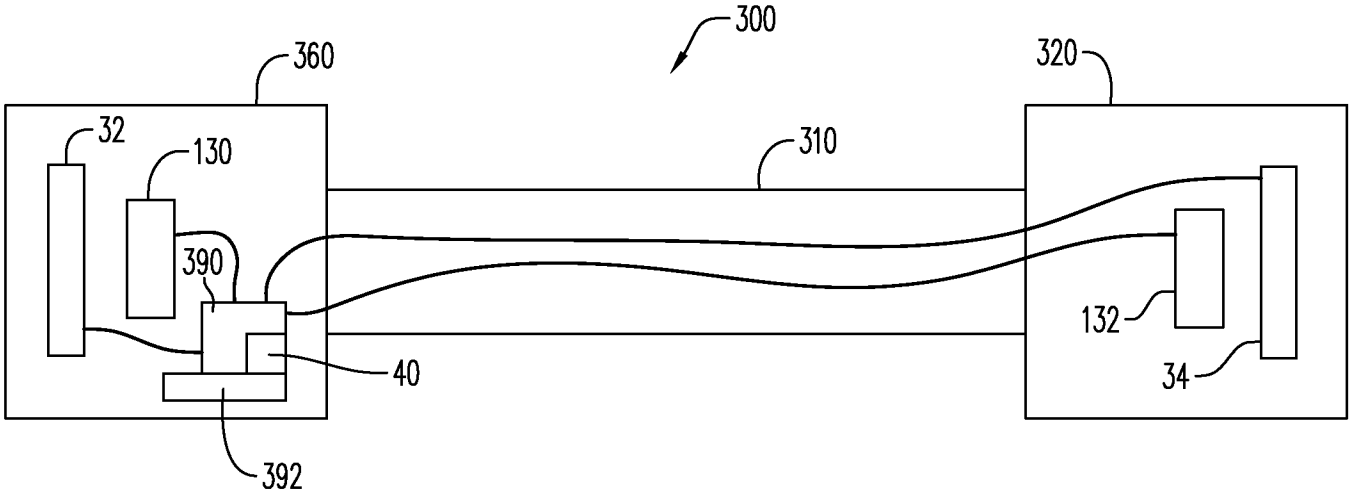
FIG. 20 is a block diagram, cross sectional view of a drone in accordance with an embodiment.

FIG. 20 illustrates an untethered drone 300 including a first ultrasonic transceiver 130, a second ultrasonic transceiver 132, a first coil 32, a second coil 34, an oscillator circuit 40, a power supply 392 and a computer/processor 390. Each of the ultrasonic transceivers 130, 132 and the coils 32, 34 are electrically connected to the computer/processor 390. In addition, the oscillator circuit 40 is either part of computer/processor 390 or connected thereto. Similarly, power supply 392 is either physically or electrically connected to computer/processor 390. The untethered drone 300 shown in FIG. 20 may utilize either or both the ultrasonic transceiver navigation system and the coil/oscillator navigation system presented herein.

The untethered drone 300 disclosed herein and illustrated in FIG. 20, for example, may represent any type of drone. For example, the untethered drone 300 may take the form of the perforating gun shown in FIGS. 2A and 2B. The body portion 310 of the untethered drone 300 may bear one or more shaped charges 340, as illustrated in FIGS. 2A and 2B. As is known in the art, detonation of the shaped charges 340 is typically initiated with an electrical pulse or signal supplied to a detonator. The detonator of the perforating gun embodiment of the untethered drone 300 may be located in the body portion 310 or adjacent the intersection of the body portion 310 and the head portion 320 or the tail portion 360 to initiate the shaped charges 340 either directly or through an intermediary structure such as a detonating cord 350 (FIGS. 2A and 2B).

Obviously, electrical power typically supplied via the wireline cable 12 to wellbore tools, such as a tethered drone or typical perforating gun, would not be available to the untethered drone 300. In order for all components of the untethered drone 300 to be supplied with electrical power, a power supply 392 may be included as part of the untethered drone 300. The power supply 392 may occupy any portion of the drone 300, i.e., one or more of the body 310, head 320 or tail 360. It is contemplated that the power supply 392 may be disposed so that it is conveniently located near components of the drone 300 that require electrical power.

An on-board power supply 392 for a drone 300 may take the form of an electrical battery; the battery may be a primary battery or a rechargeable battery. Whether the power supply 392 is a primary or rechargeable battery, it may be inserted into the drone at any point during construction of the drone 300 or immediately prior to insertion of drone 300 into the wellbore 16. If a rechargeable battery is used, it may be beneficial to insert the battery in an uncharged state and charge it immediately prior to insertion of the drone 300 into the wellbore 16. Charge times for rechargeable batteries are typically on the order of minutes to hours.

In an embodiment, another option for power supply 392 is the use of a capacitor or a supercapacitor. A capacitor is an electrical component that consists of a pair of conductors separated by a dielectric. When an electric potential is placed across the plates of a capacitor, electrical current enters the capacitor, the dielectric stops the flow from passing from one plate to the other plate and a charge builds up. The charge of a capacitor is stored as an electric field between the plates. Each capacitor is designed to have a particular capacitance (energy storage). In the event that the capacitance of a chosen capacitor is insufficient, a plurality of capacitors may be used. When a capacitor is connected to a circuit, a current will flow through the circuit in the same way as a battery. That is, when electrically connected to elements that draw a current the electrical charge stored in the capacitor will flow through the elements. Utilizing a DC/DC converter or similar converter, the voltage output by the capacitor will be converted to an applicable operating voltage for the circuit. Charge times for capacitors are on the order of minutes, seconds or even less.

A supercapacitor operates in a similar manner to a capacitor except there is no dielectric between the plates. Instead, there is an electrolyte and a thin insulator such as cardboard or paper between the plates. When a current is introduced to the supercapacitor, ions build up on either side of the insulator to generate a double layer of charge. Although the structure of supercapacitors allows only low voltages to be stored, this limitation is often more than outweighed by the very high capacitance of supercapacitors compared to standard capacitors. That is, supercapacitors are a very attractive option for low voltage/high capacitance applications as will be discussed in greater detail hereinbelow. Charge times for supercapacitors are only slightly greater than for capacitors, i.e., minutes or less.

A battery typically charges and discharges more slowly than a capacitor due to latency associated with the chemical reaction to transfer the chemical energy into electrical energy in a battery. A capacitor is storing electrical energy on the plates so the charging and discharging rate for capacitors are dictated primarily by the conduction capabilities of the capacitors plates. Since conduction rates are typically orders of magnitude faster than chemical reaction rates, charging and discharging a capacitor is significantly faster than charging and discharging a battery. Thus, batteries provide higher energy density for storage while capacitors have more rapid charge and discharge capabilities, i.e., higher power density, and capacitors and supercapacitors may be an alternative to batteries especially in applications where rapid charge/discharge capabilities are desired.

Thus, an on-board power supply 392 for a drone 300 may take the form of a capacitor or a supercapacitor, particularly for rapid charge and discharge capabilities. A capacitor may also be used to provide additional flexibility regarding when the power supply is inserted into the drone 300, particularly because the capacitor will not provide power until it is charged. Thus, shipping and handling of a drone 300 containing shaped charges 430 or other explosive materials presents low risks where an uncharged capacitor is installed as the power supply 392. This is contrasted with shipping and handling of a drone 300 with a battery, which can be an inherently high-risk activity and frequently requires a separate safety mechanism to prevent accidental detonation. Further, and as discussed previously, the act of charging a capacitor is very fast. Thus, the capacitor or supercapacitor being used as a power supply 392 for drone 300 can be charged immediately prior to deployment of the drone 300 into the wellbore 16.

While the option exists to ship a drone 300 preloaded with a rechargeable battery which has not been charged, i.e., the electrochemical potential of the rechargeable battery is zero, this option comes with some significant drawbacks. The goal must be kept in mind of assuring that no electrical charge is capable of inadvertently accessing any and all explosive materials in the drone 300. Electrochemical potential is often not a simple, convenient or failsafe thing to measure in a battery. It may be the case that the potential that a 'charged' battery may be mistaken for an 'uncharged' battery simply cannot be reduced sufficiently to allow for shipping a drone 300 with an uncharged battery. In addition, as mentioned previously, the time for charging a rechargeable battery having adequate power for drone 300 could be on the order of an hour or more. Currently, fast recharging batteries of sufficient charge capacity are uneconomical for the 'one-time-use' or 'several-time-use' that would be typical for batteries used in drone 300.

In an embodiment, electrical components like the computer/processor 390, the oscillator circuit 40, the coils 32, 34, and the ultrasonic transceivers 130, 132 may be battery powered while explosive elements like the detonator for initiating detonation of the shaped charges 340 are capacitor powered. Such an arrangement would take advantage of the possibility that some or all of the computer/processor 390, the oscillator circuit 40, the coils 32, 34, and the ultrasonic transceivers 130, 132 may benefit from a high-density power supply having higher energy density, i.e., a battery, while initiating elements such as detonators typically benefit from a higher power density, i.e., capacitor/supercapacitor. A very important benefit for such an arrangement is that the battery is completely separate from the explosive materials, affording the potential to ship the drone 300 preloaded with a charged or uncharged battery. The power supply that is connected to the explosive materials, i.e., the capacitor/supercapacitor, may be very quickly charged immediately prior to dropping drone 300 into wellbore 50.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make substitutions possible that are not now contemplated by reason of the imprecision of language; these variations should be covered by the appended claims. This written description uses examples to disclose the method, machine and computer-readable medium, including the exemplary embodiments, and also to enable any person of skill in the art to practice these, including making and using any devices or systems and performing any incorporated methods. The patentable scope thereof is defined by the claims, and may include other examples that occur to those of skill in the art. Such other examples are intended to be within the scope of the claims if, for example, they have structural elements that do not differ from the literal language of the claims, or if they include structural elements with insubstantial differences from the literal language of the claims.

What is claimed is:

1. A wellbore navigation system for use with an untethered drone, comprising:

a first ultrasound transceiver and a second ultrasound transceiver, each configured to transmit an ultrasound signal and receive a return signal;

a processor, wherein the processor is configured to monitor the return signals received by the first ultrasound transceiver and the second ultrasound transceiver to identify an anomalous point along the wellbore, the anomalous point comprising a geological formation external to the wellbore casing, and calculate a set of topology data for the wellbore; and a power supply electrically attached to the processor and the ultrasound transceivers.

2. The wellbore navigation system of claim 1, wherein the processor is configured to calculate a parameter from the group consisting of at least one of a velocity of the navigation system through the wellbore, a position of the navigation system in the wellbore and the set of topology data for the wellbore, the parameter calculated based on a time difference between identification of the anomalous point determined from the first return signal and identification of the anomalous point determined from the second return signal.

3. The wellbore navigation system of claim 1, further comprising:

an untethered drone assembly sized to travel through a wellbore; and the wellbore navigation system being part of to the untethered drone assembly.

4. The wellbore navigation system of claim 1, wherein the power supply being selected from the group consisting of a battery and a capacitor.

5. The wellbore navigation system of claim 1, wherein one of the first ultrasound transceiver and the second ultrasound transceiver comprises:

a housing; and an active element provided within the housing, wherein the active element is configured to both transmit an ultrasound signal and receive an ultrasound signal.

6. The wellbore navigation system of claim 1, wherein one of the first ultrasound transceiver and the second ultrasound transceiver comprises:

a housing having a first end;

a transmitting element provided within the housing;

a receiving element provided within the housing;

an acoustic barrier provided between the transmitting element and the receiving element;

a first delay material provided between the transmitting element and the first end; and a second delay material provided between the receiving element and the first end.

7. An untethered drone for insertion into a wellbore, the untethered drone comprising:

a drone body having a distal end, a proximal end and a body axis that is substantially coaxial with an axis of the wellbore;

a navigation system comprising:

a first ultrasonic transceiver configured to transmit a first ultrasound signal and receive a first return signal and a second ultrasonic transceiver configured to transmit a second ultrasound signal and receive a second return signal, the first and second ultrasonic transceivers are axially displaced with respect to one another along the body axis so as to successively traverse each point of the wellbore;

a processor configured to monitor the first return signal to identify an anomalous point along the wellbore and to monitor the second return signal to identify the anomalous point along the wellbore, the anomalous point comprising a geological formation external to the wellbore casing, and calculate a set of topology data for the wellbore; and a power supply selected from the group consisting of a battery and a capacitor, the power supply electrically attached to the processor and the ultrasound transceivers.

8. The untethered drone of claim 7, wherein the processor is configured to calculate a parameter from the group consisting of at least one of a velocity of the navigation system through the wellbore, a position of the navigation system in the wellbore and the set of topology data for the wellbore, the parameter calculated based on a time difference between identification of the anomalous point determined from the first return signal and identification of the anomalous point determined from the second return signal.

9. The untethered drone of claim 7, further comprising:

an electronic filter associated with the processor, the filter configured to remove noise from each return signal.

10. The untethered drone of claim 7, further comprising:

a shaped charge inserted into the drone body such that the shaped charge is exposed to an exterior of the drone body.

11. The untethered drone of claim 7, further comprising a plurality of fins extending from the drone body.

12. A method of determining a location of an untethered drone along a wellbore, the method comprising the steps of:

charging a power supply comprising at least one of a battery and a capacitor, inserting an untethered drone into the wellbore, the untethered drone having a drone body, a body axis that is substantially coaxial with an axis of the wellbore, a distal end and a proximal end disposed along the body axis;

providing a navigation system as part of the drone body, the navigation system comprising:

a first ultrasonic transceiver and a second ultrasonic transceiver axially displaced with respect to one another along the body axis so as to successively traverse a portion of the wellbore; and a processor;

initially identifying an anomalous point along the wellbore by transmitting a first ultrasound signal and receiving a first return signal with the first ultrasonic transceiver and processing the first return signal with the processor, the anomalous point comprising a geological formation external to the wellbore casing;

secondarily identifying the anomalous point along the wellbore by transmitting a second ultrasound signal and receiving a second return signal with the second ultrasonic transceiver and processing the second return signal with the processor; and calculating, via the processor, a set of topology data for the wellbore.

13. The method of claim 12, wherein the first ultrasonic transceiver is located adjacent the distal end of the untethered drone and the second ultrasonic transceiver is located adjacent the proximal end of the untethered drone.

14. The method of claim 12, further comprising the step of:

calculating a parameter from the group consisting of at least one of a velocity of the navigation system through the wellbore, a position of the navigation system in the wellbore and the set of topology data for the wellbore, the parameter calculated based on a time difference between the initial identification and the secondary identification.

15. The method of claim 12, further comprising the step of:

filtering the first and second return signals to remove electronic noise.

* * * * *